US009878367B1

(12) United States Patent
Donahue et al.

(10) Patent No.: US 9,878,367 B1
(45) Date of Patent: Jan. 30, 2018

(54) CONGRUENT MELTING SALT ALLOYS FOR USE AS SALT CORES IN HIGH PRESSURE DIE CASTING

(71) Applicant: Brunswick Corporation, Lake Forest, IL (US)

(72) Inventors: Raymond J. Donahue, Fond du Lac, WI (US); Mark T. Degler, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/350,942

(22) Filed: Nov. 14, 2016

Related U.S. Application Data

(63) Continuation of application No. 14/467,820, filed on Aug. 25, 2014, now Pat. No. 9,527,131.

(60) Provisional application No. 61/919,073, filed on Dec. 20, 2013.

(51) Int. Cl.
*B22C 9/10* (2006.01)
*B22D 17/00* (2006.01)

(52) U.S. Cl.
CPC ..... *B22C 9/105* (2013.01); *B22D 17/00* (2013.01)

(58) Field of Classification Search
CPC ..... B22C 9/10; B22C 9/105; B22C 1/00
USPC ..... 164/369, 522
See application file for complete search history.

(56) References Cited

U.S. PATENT DOCUMENTS

| | | | | |
|---|---|---|---|---|
| 4,840,219 | A | 6/1989 | Foreman | |
| 4,875,517 | A | 10/1989 | Donahue et al. | |
| 5,165,464 | A | 11/1992 | Donahue et al. | |
| 8,820,389 | B1 | 9/2014 | Degler | |
| 9,527,131 | B1 * | 12/2016 | Donahue et al. | B22C 9/105 164/113 |
| 2009/0288797 | A1 | 11/2009 | Yaokawa et al. | |

* cited by examiner

*Primary Examiner* — Kevin P Kerns
(74) *Attorney, Agent, or Firm* — Andrus Intellectual Property Law, LLP

(57) ABSTRACT

Congruent melting salt alloys for use as salt cores in high pressure die casting of metallic alloys for the production of complex metallic parts. Congruent melting salt alloys provide mechanical advantages in the high pressure die casting of both aluminum and magnesium alloys. Salt cores may be used to make complex high pressure die casting parts such as internal passages in a closed deck engine block. The congruently melting salt alloy is cast into a shape of a desired salt core. The cast salt core of the congruently melting slat alloy is placed into a high pressure die casting mold for a complex object. Molten metal is introduced into the high pressure die casting mold to form the complex part. The congruently melting salt alloys may be readily removed from the final cast part through flushing with a solvent, such as water, or through other processes known in the art.

15 Claims, 22 Drawing Sheets

CONGRUENT MELTING SALT ALLOYS FOR USE AS SALT CORES IN HIGH PRESSURE DIE CASTING

CROSS REFERENCE TO RELATED APPLICATION

This application is a continuation of U.S. patent application Ser. No. 14/467,820, filed Aug. 25, 2014, and issued as U.S. Pat. No. 9,527,131, which is incorporated herein by reference in entirety. The '820 application claims the benefit of and priority to U.S. Provisional Patent Application No. 61/919,073 filed Dec. 20, 2013, which is hereby incorporated by reference in its entirety.

FIELD

The present application relates to high pressure die casting, particularly to salt cores used to manufacture complex parts through the high pressure die casting process.

BACKGROUND

The high pressure die casting (HPDC) process is the most popular casting process for aluminum alloys and is prevalent in the casting of magnesium alloys. 70% of all aluminum cast is accomplished through the HPDC process. Salt cores may also be used in other types of casting processes. The HPDC process is somewhat limited because design features have to be compatible with the opening and closing of dies in the horizontal direction.

Salt cores are used in the HPDC process to assist in the economical production of complex parts. The most widely used expendable, high integrity core used in HPDC is a fused salt core. It generally can withstand the dynamic and static forces of the die casting process, the temperature of the metal and yet is easily removed by dissolving the core with water. The wash out of the salt core is fast and easy. For example, with HPDC engine blocks, two blocks with salt cores may be placed in a water spray cabinet and washed out in the time it takes to make another engine block. The used salt can be recycled or it can be allowed to flow down the drain because it is food quality grade and not toxic.

It is the general practice to make fused salt cores by a die casting process where the molten salt mixture is poured into a die having the shape of the salt core desired to be used in the subsequent HPDC process. Still, salt cores can pick up moisture if stored for a week. Thus, salt cores are made in the casting plant that uses them with "on demand" processing. The 100% salt concentration cores (unlike salt at 3.5% concentrations in water) are not corrosive to any steel part of the die casting machine. Spills can easily be cleaned up and anything the molten salt solidifies on or spills onto while casting the cores may be ignored until it presents a physical barrier to activity.

Fused salt cores are made typically and traditionally from a mechanical mixture of NaCl and $Na_2CO_3$. This mechanical mixture is molten and introduced to a mold to create the desired shape of the salt core. The salt core thus produced is used in the HPDC process for casting a metal part. The salt core is spaced from the walls of the die to provide a die cavity, and a molten metal, such as an aluminum alloy, having a melting point less than the melting point of the salt core, is introduced into the die cavity and on solidifying provides a cast metal part. The cast part is then removed from the die and the salt core is removed from the cast part by washing the part in a solvent, such as water, that will dissolve the salt core.

The mixture of NaCl and $Na_2CO_3$ is advantageous for casting aluminum alloys because the eutectic temperature of the mixture is 635° C., 83° C. higher than the eutectic temperature of aluminum silicon (AlSi) alloys at 577° C. However, as shown in FIG. 1, NaCl and $Na_2CO_3$ exhibit no solubility in one another. Since NaCl and $Na_2CO_3$ are each independently brittle, the resulting eutectic which is a mechanical mixture of pure NaCl and pure $Na_2CO_3$ is likewise brittle, yielding the high possibility of shrinkage of the two different salts resulting in fissures in the salt core that ultimately affects the quality of the final cast part.

The brittleness of these pure salts is readily interpreted in terms of the packing arrangement of the ions. Deformation of the crystal, that is, sliding of one plane of atoms past another, for a distance of about one ion diameter, bring ions of like charge into contact. Their strong mutual repulsion breaks the crystal. The break occurs between the planes of atoms and leads to new crystal faces.

Thus, certain limitations exist with traditional salt cores, particularly when the shrinkage of the salt upon cooling is significantly greater than the shrinkage of the metal die. This shrinkage leads to cracking of the core that increases the rejection rate of the HDPC cast metal object. Accordingly, developing salt cores that have reduced shrinkage values will result in HPDC castings that have significantly less flaws in the cavities formed by the salt cores.

SUMMARY

The present application identifies binary isomorphous salt systems where a liquidus phase and solidus phase do not descend continuously from the melting temperature of one salt to that of the other as in the NaCl—$Na_2CO_3$ system shown in FIG. 1. Instead, the liquidus solidus phases pass through a minimum temperature that lies below the melting point of both salt components as shown in FIGS. 2 through 18. When this occurs, the liquidus and solidus meet at the minimum point. In other words, the alloy salts melt and freeze with the liquid and solid phase undergoing no change in composition. Thus, an alloy salt having the composition of the minimum melting point behaves like a pure salt—it melts and freezes isothermally and exhibits no coring in its cast structure. These alloy salts are referred to herein as congruently melting salt alloys, and have mechanical properties that are very different from the two pure salts from which the "alloy" salt was made. This is quite unlike the situation with eutectic salt systems, wherein there is no solubility in the solid state between the pure salts and wherein the mechanical properties follow the law of mixtures of the pure salts.

Accordingly, the present application recognizes that enhanced shrinkage properties may be realized in congruent melting alloys for several reasons. Initially, lowering the temperature from the high melting point of pure salt to the low melting point of the congruent melting alloy composition decreases the distance between the atoms in the liquid, and increases the liquid density of the congruent melting alloy. Further, by decreasing the melting point of the congruent melting alloy salt, the ionic bond strengthen in the ionic solids decreases because the distance between the atoms in the alloy salt with the lower melting point increases. This favors easier alloying of atoms of different sizes, increases the strain energy and enthalpy of mixing. All of this decreases the solid density of the congruent melting alloy compared to the solid density of the high melting point pure salts.

Additionally, the largest lattice parameter in solid solution occurs at the congruent melting point composition when the critical temperature for the miscibility gap (i.e., where one solid decomposes to two solids as the temperature drops) is near the minimum congruent melting point. At higher heats of mixing, the upper critical temperature for the miscibility gap coincides with the minimum congruent melting point and the solid solution condition of the congruent melting alloy below its melting point is lost because the eutectic is formed. Thus, the lowest shrinkage occurs when the liquid has its highest density at the lowest minimum congruent MP when the critical temperature for the miscibility gap is near the minimum congruent temperature MP and when the solid solution density is lowest, i.e., at the congruent MP composition very near the solidus temperature. Moreover, this congruent melting alloy shrinkage value is smaller than any shrinkage value obtained from the corresponding eutectic system, because the pure salts in the eutectic systems, unlike the solid solution alloys at the congruent MP compositions, have higher strength bonds reflected in their higher melting points of the pure salts in the eutectic structure, and reflected in a higher solid state density.

Unlike the eutectic composition where the eutectic is just a 50/50 mechanical mixture of the pure salts, the congruent melting alloy composition is "a true alloy composition" and the mechanical properties of this alloy composition is unrelated to the mechanical properties of the pure salts through the law of mixtures. As a result, the solid density at the congruent alloy melting point, is less than the solid density at eutectic melting point temperature or at either pure salt melting points, because the bond strengths holding together the atoms of the pure salts are much larger than the bond strengths holding together congruent melting alloy of much lower melting point. This translates into a lower shrinkage for the congruent melting alloy than either of the two pure salts used to make the alloy salt, or a corresponding eutectic composition consisting of a mechanical mixture of the pure salts.

The present application discloses congruent melting salt alloys that provide mechanical advantages in the high pressure die casting of both aluminum and magnesium alloys. Particularly, this application is directed to high pressure die casting salt cores for use in high pressure die casting processes that are made from a congruently melting salt alloy system as opposed to a combination of salts that exhibit no solubility in one another. The salt cores may be selected from one of the following congruently melting salt alloy systems: KBr—KCl; KBr—KI; KBr—NaBr; KBr—RbBr; $CaCl_2$—$SrCl_2$; CsBr—CsI; CsCl—KCl; $CsNO_3$—$RbNO_3$; $K_2CO_3$—$Na_2CO_3$; $K_2SO_4$—$Na_2SO_4$; KI—NaI; KI—NaCl; KI—RbI; LiBr—LiCl; LiCl—NaCl; $Na_2CO_3$—$Na_2SO_4$; KCl—NaCl; NaBr—NaCl; KCl—KI; KCl—NaBr or KBr—NaCl.

In some instances, when the high pressure die casting process is an aluminum alloy high pressure die casting process, the congruently melting salt alloy system is selected from one of the following systems: KBr—KCl; KBr—KI; KBr—NaBr, KBr—RbBr; $CaCl_2$—$SrCl_2$; CsCl—KCl; $K_2CO_3$—$Na_2CO_3$; $K_2SO_4$—$Na_2SO_4$; KI—RbI; $Na_2CO_3$—$Na_2SO_4$; KCl—NaCl; NaBr—NaCl; KCl—KI; KCl—NaBr or KBr—NaCl.

In other instances, where the high pressure die casting process is a magnesium alloy high pressure die casting process, the congruently melting salt alloy system used to make the salt cores of the present application is selected from one of the following systems: KBr—KCl; KBr—KI; KBr—NaBr; KBr—RbBr; $CaCl_2$—$SrCl_2$; CsBr—CsI; CsCl—KCl; $K_2CO_3$—$Na_2CO_3$; $K_2SO_4$—$Na_2SO_4$; LiBr—LiCl; LiCl—NaCl; KI—NaI; KI—NaCl; KI—RbI; $Na_2CO_4$—$Na_2SO_4$; KCl—NaCl; NaBr—NaCl; KCl—KI; KCl—NaBr or KBr—NaCl.

In yet other instances, when the high pressure die casting process is an aluminum alloy high pressure die casting process, the salt core is made from a congruently melting salt alloy system selected from one of the following systems: KBr—KCl; KBr—KI; KBr—NaBr; NaBr—NaCl; $K_2CO_3$—$Na_2CO_3$; KCl—NaCl; KCl—NaBr or KBr—NaCl.

The salt cores may be used to make complex high pressure die casting parts as described in the background. For example, and without limitation, the salt core may form the passages of a cast part such as the internal passages in a closed deck engine block. In yet other instances, the salt cores may be used to provide the porting in the cylinder bores for hypereutectic Al—Si liner-less 2-cycle engine blocks. Further, automotive heads or motor cycle heads which are made with sand cores in the expensive permanent casting process can be made in high pressure die casting with salt cores more economically.

Accordingly, the present application also contemplates a method of high pressure die casting a complex object. This method first contemplates the steps of obtaining a congruently melting salt alloy and casting the congruently melting salt alloy into a desired shape, that shape comprising a salt core. As noted, casting the salt alloy into a salt core contemplates creating a molten solution of the identified congruity melting salt system and introducing it into a mold to create a salt core of the desired shape. The method also contemplates the placement of a congruently melting salt alloy salt core into a high pressure die casting mold for a complex object. Molten metal is introduced into the high pressure die casting mold to form the complex part. The molten alloy is allowed to cool, and the cast complex object may be removed from the high pressure die casting mold. Once the cast complex object is removed, the salt cores from the complex cast object may be used as known in the art, for example, through flushing with a solvent such as water.

These and other useful embodiments of the present application, fully set forth below in the detailed description and claims, and additional embodiments will be recognized by those skilled in the art.

BRIEF DESCRIPTION OF THE DRAWINGS

FIG. 1I is a graph of temperature versus mole concentration for the $K_2SO_4$—$Na_2SO_4$ congruently melting salt alloy system.

DETAILED DESCRIPTION

Figure 1:
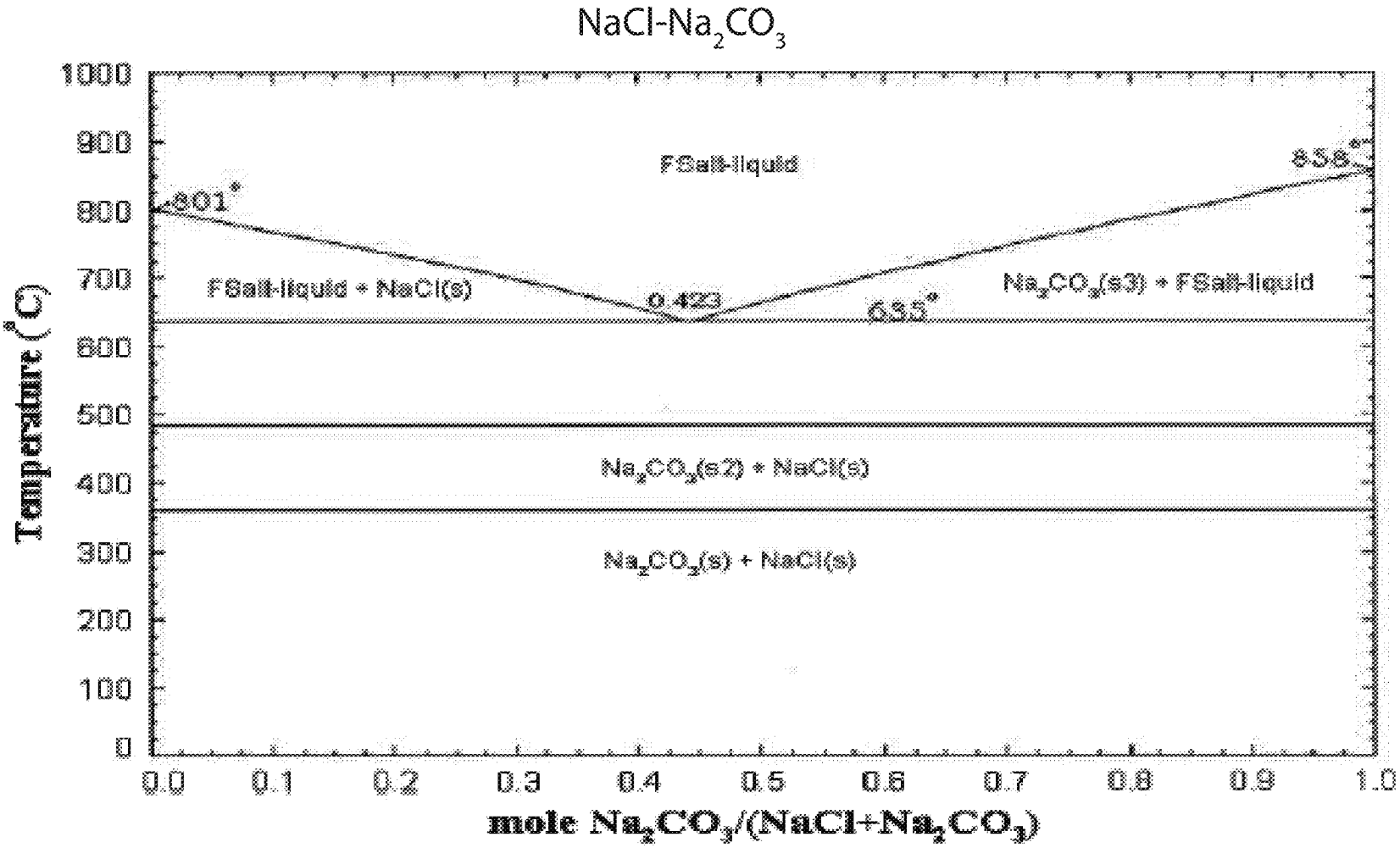
FIG. 1 is the NaCl—$Na_2CO_3$ eutectic phase diagram with a eutectic temperature of 635° C. and demonstrating that the eutectic is a mechanical mixture of the pure salt compounds because there is no solubility of either pure salt into the other.
Figure 2:
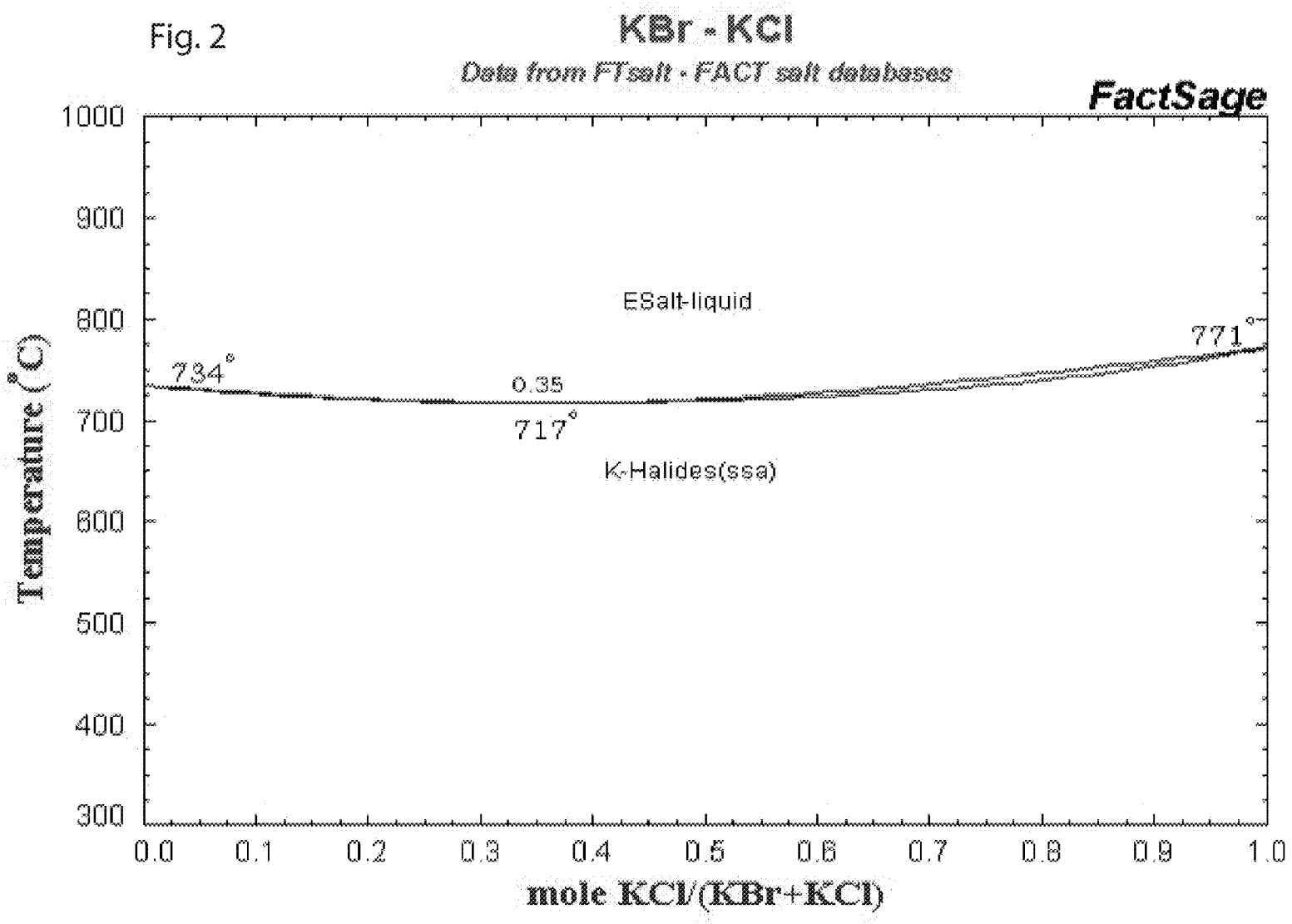
FIG. 2 is a graph of temperature versus mole concentration for the KBr—KCl congruently melting salt alloy system.
Figure 3:
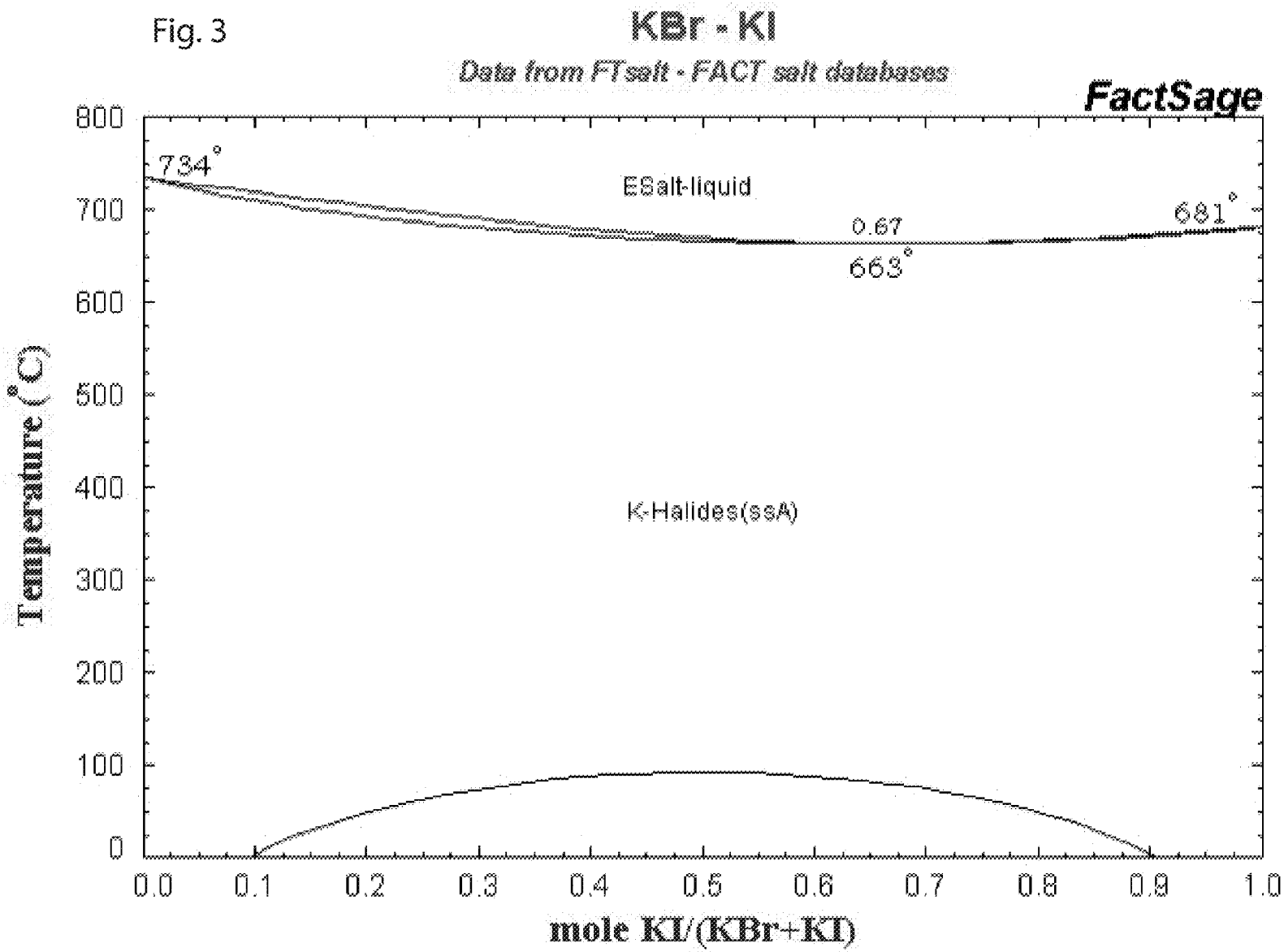
FIG. 3 is a graph of temperature versus mole concentration for the KBr—KI congruently melting salt alloy system.
Figure 4:
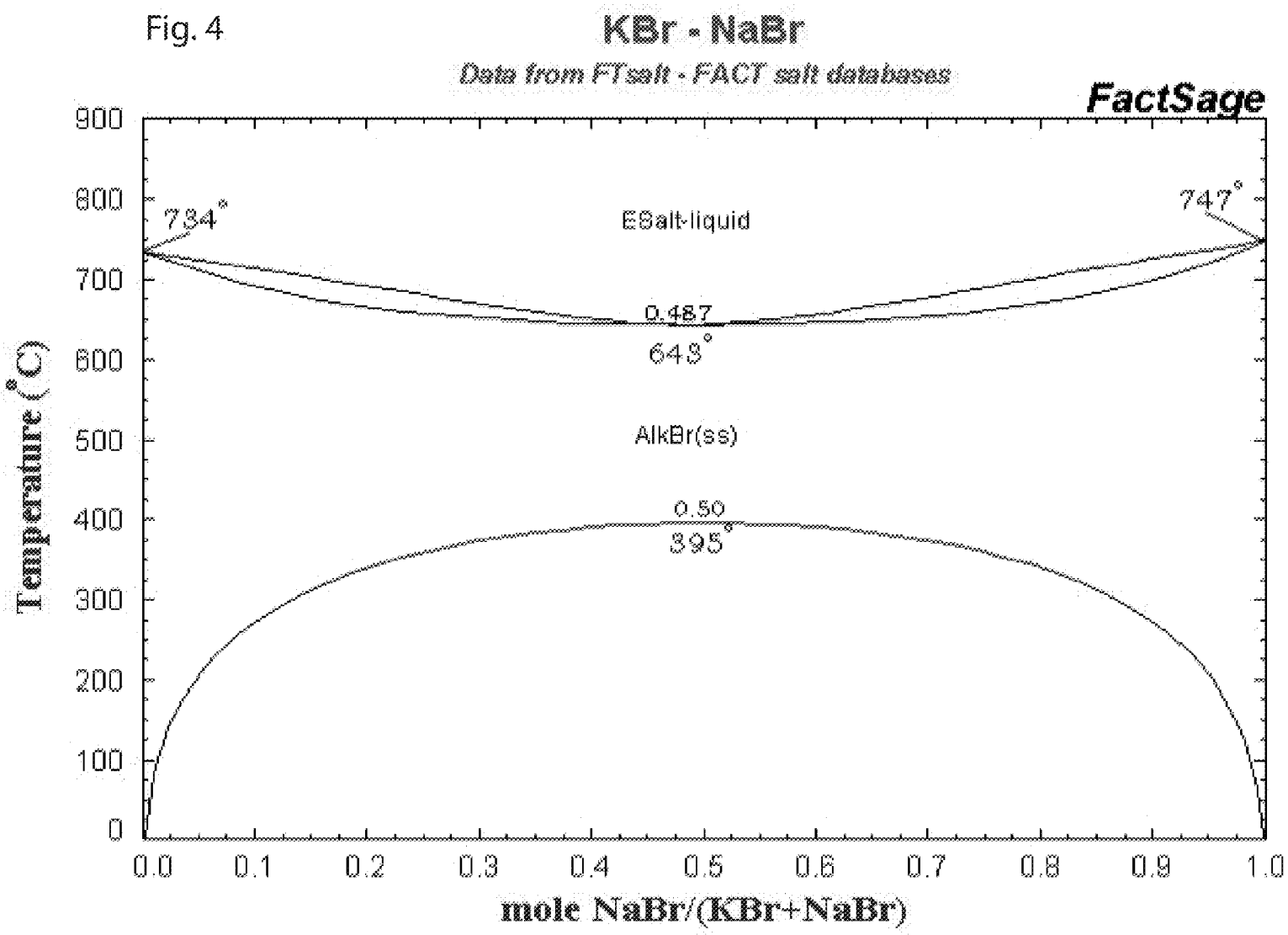
FIG. 4 is a graph of temperature versus mole concentration for the KBr—NaBr congruently melting salt alloy system.
Figure 5:
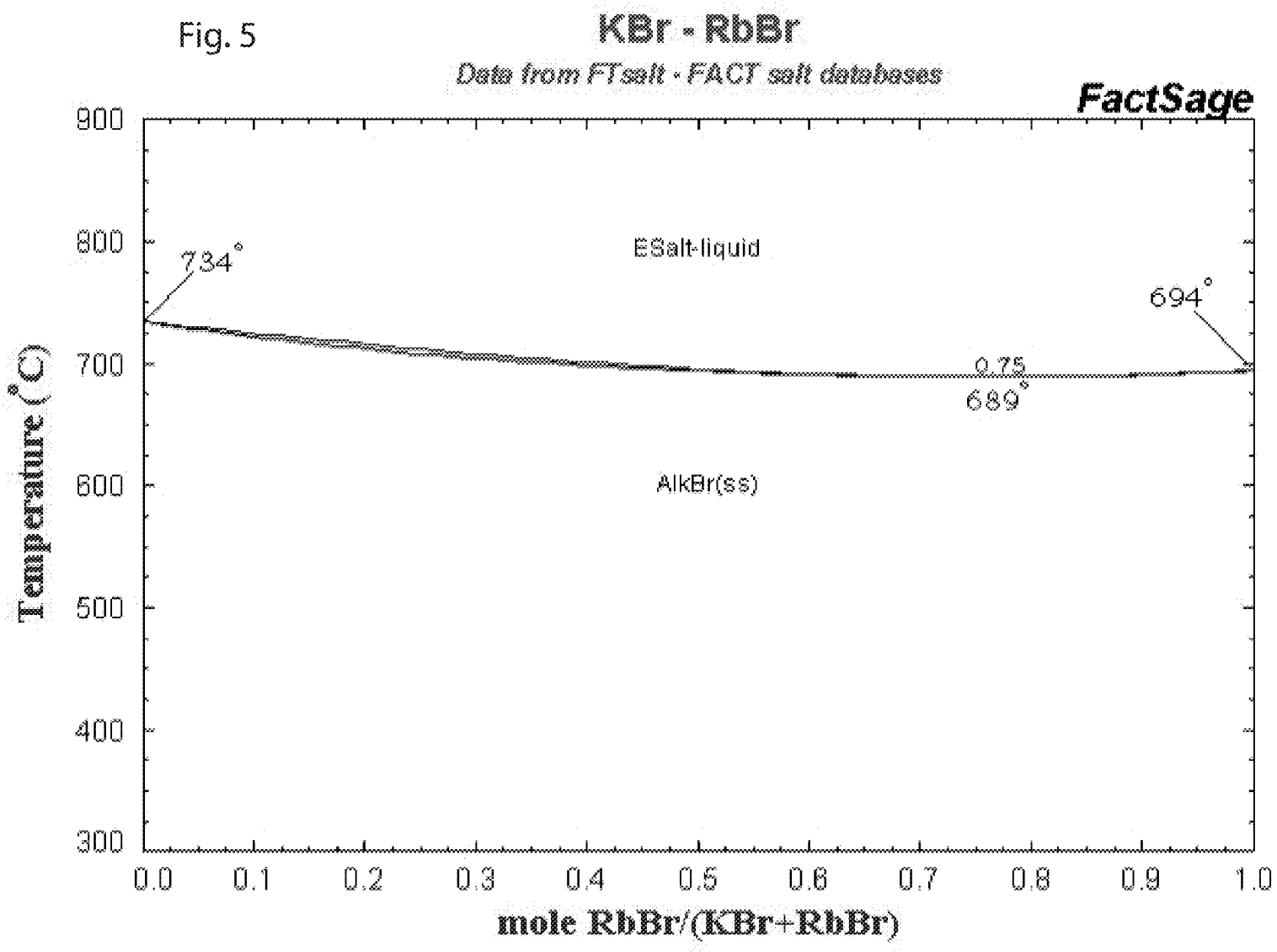
FIG. 5 is a graph of temperature versus mole concentration for the KBr—RbBr congruently melting salt alloy system.
Figure 6:
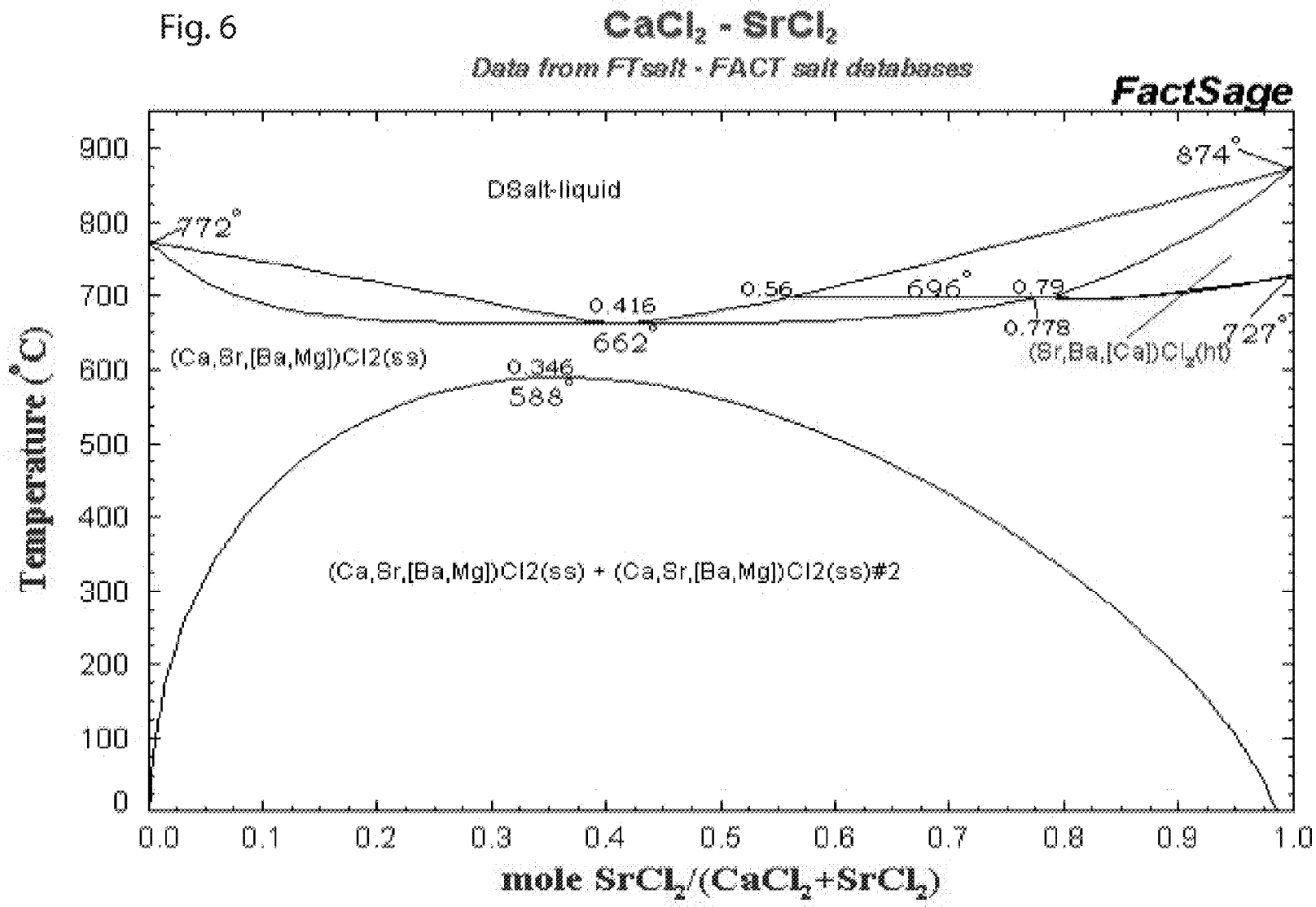
FIG. 6 is a graph of temperature versus mole concentration for the $CaCl_2$—$SrCl_2$ congruently melting salt alloy system.
Figure 7:
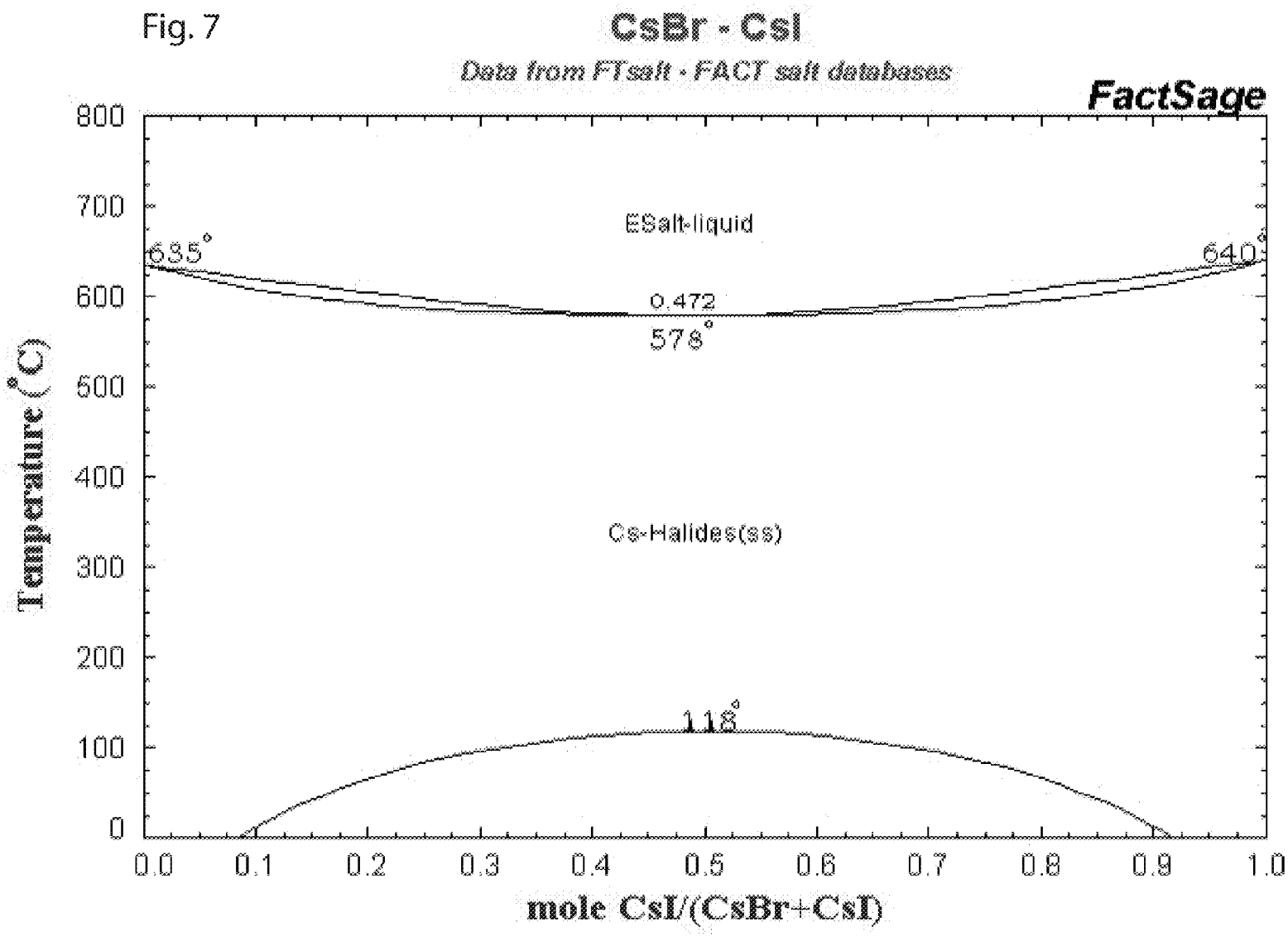
FIG. 7 is a graph of temperature versus mole concentration for the CsBr—CsI congruently melting salt alloy system.
Figure 8:
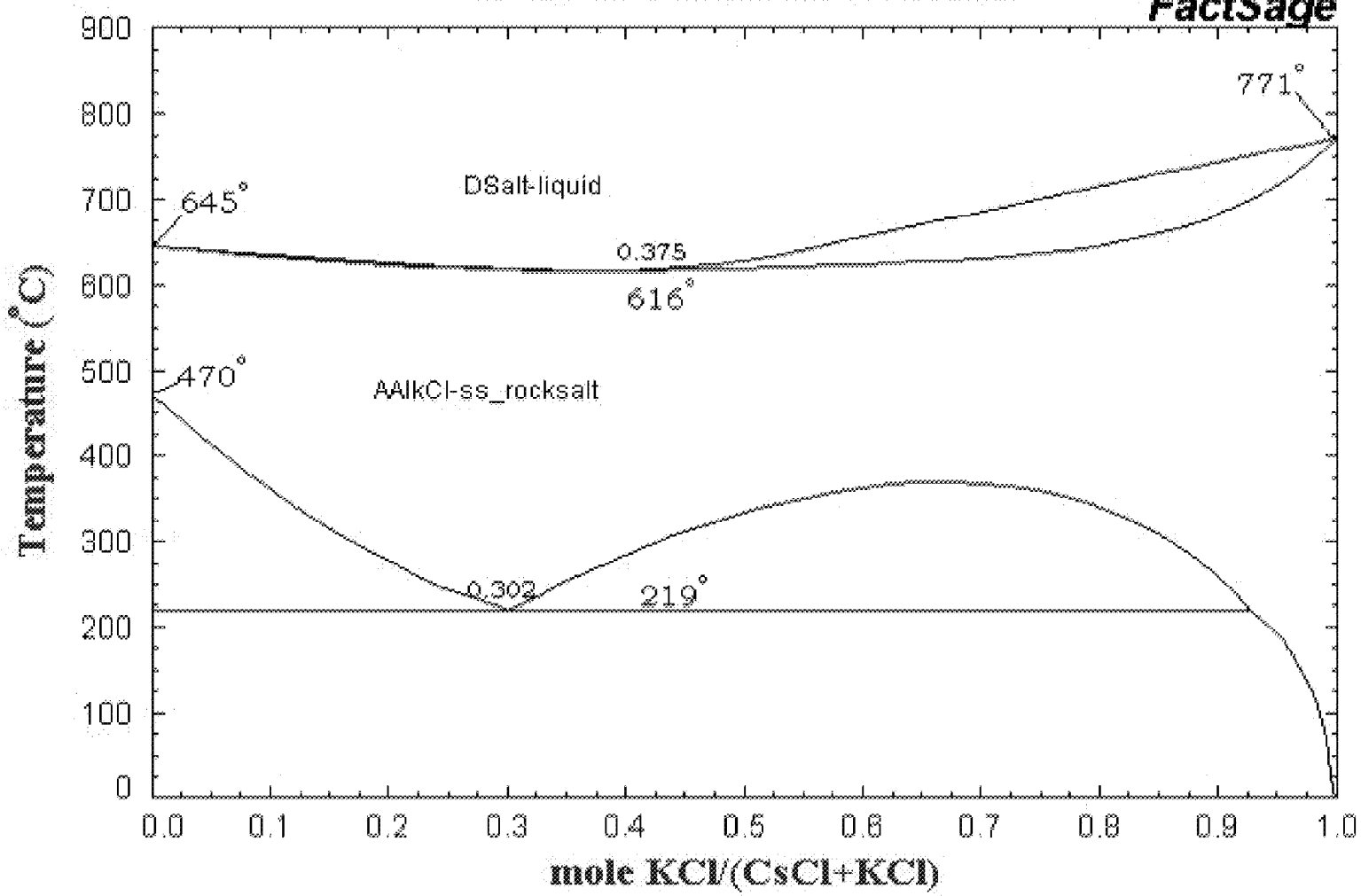
FIG. 8 is a graph of temperature versus mole concentration for the CsCl—KCl congruently melting salt alloy system.
Figure 9:
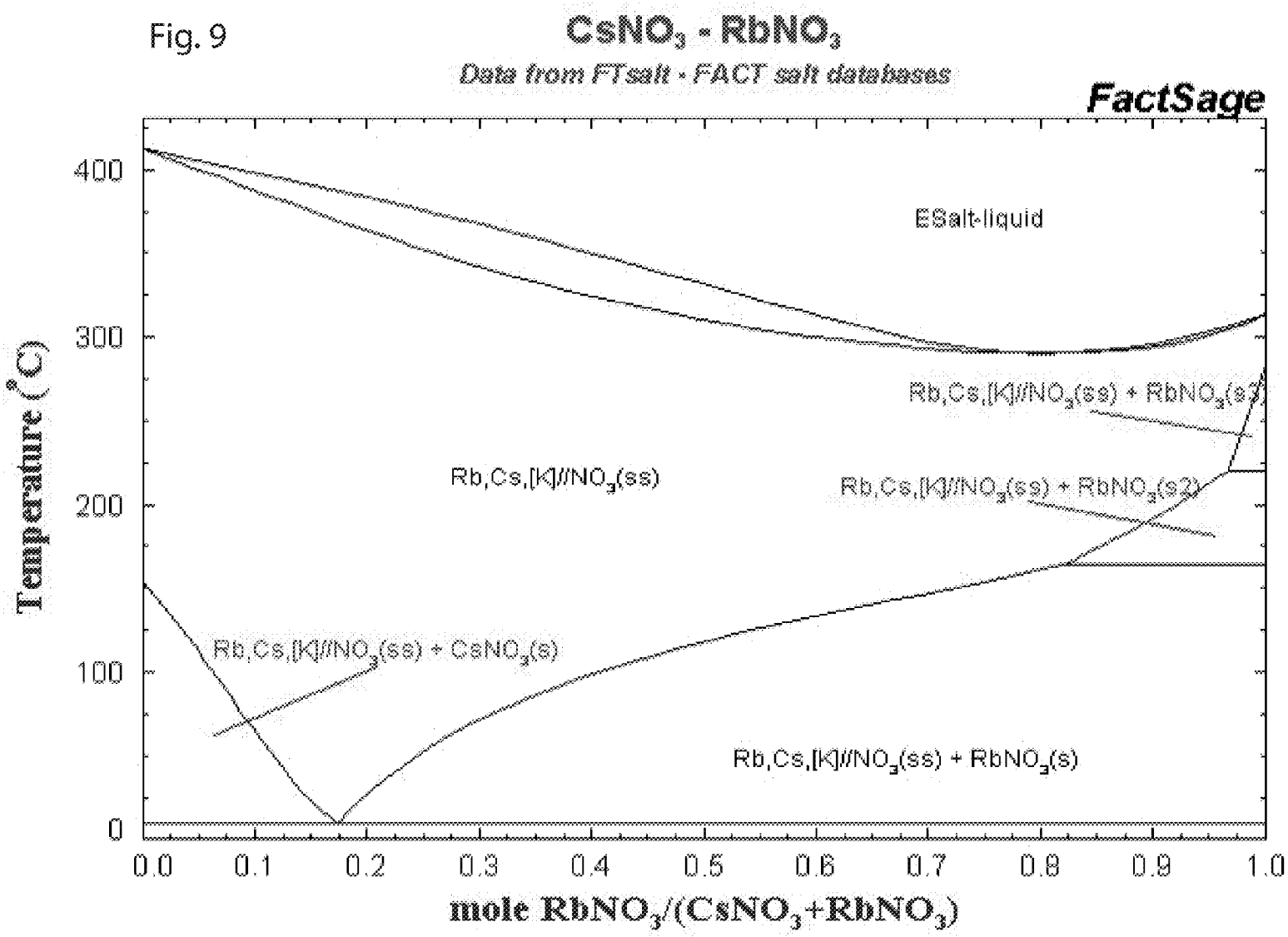
FIG. 9 is a graph of temperature versus mole concentration for the $CsNO_3$—$RbNO_3$ congruently melting salt alloy system.
Figure 10:
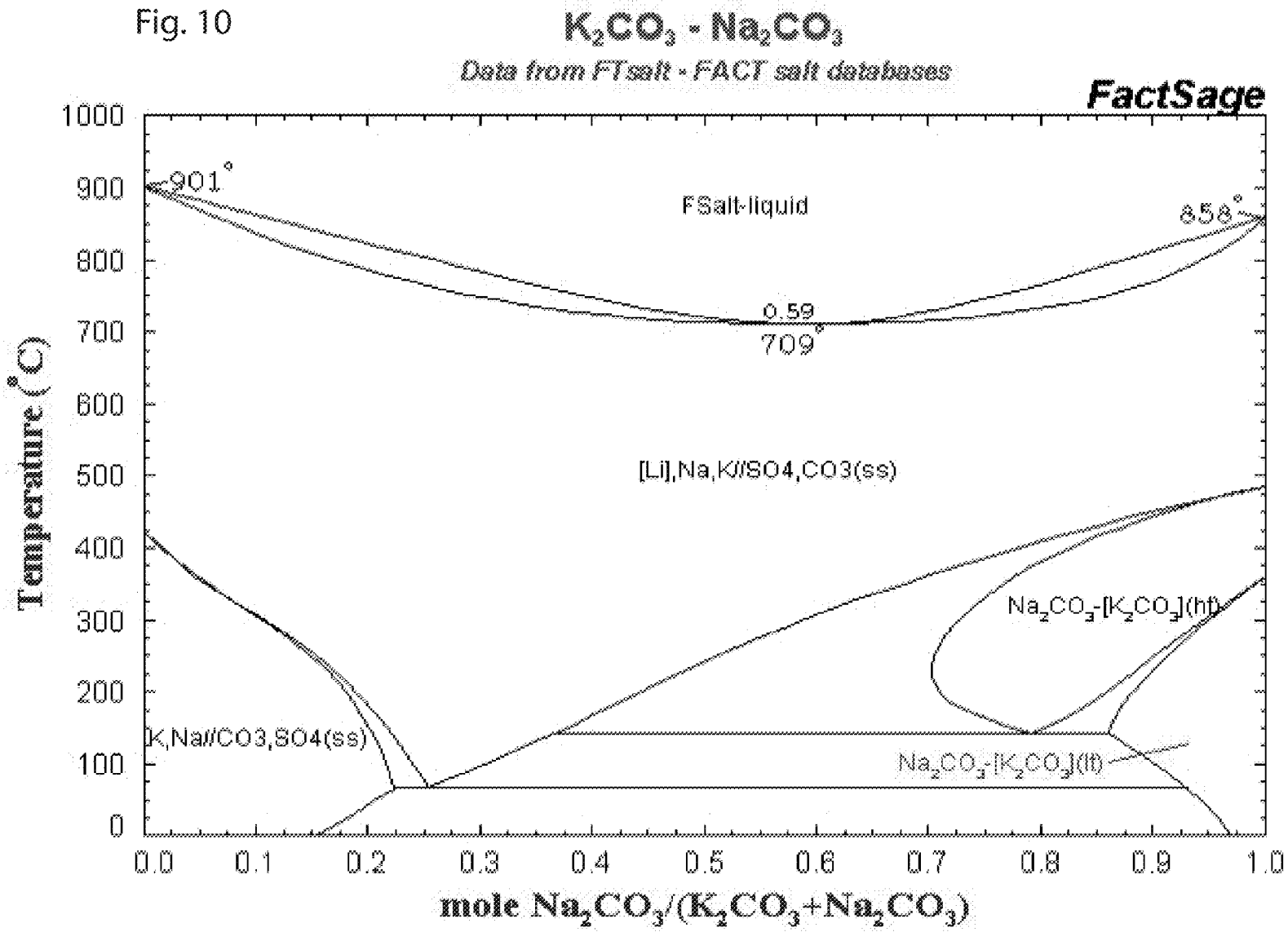
FIG. 10 is a graph of temperature versus mole concentration for the $K_2CO_3$—$Na_2CO_3$ congruently melting salt alloy system.
Figure 11:
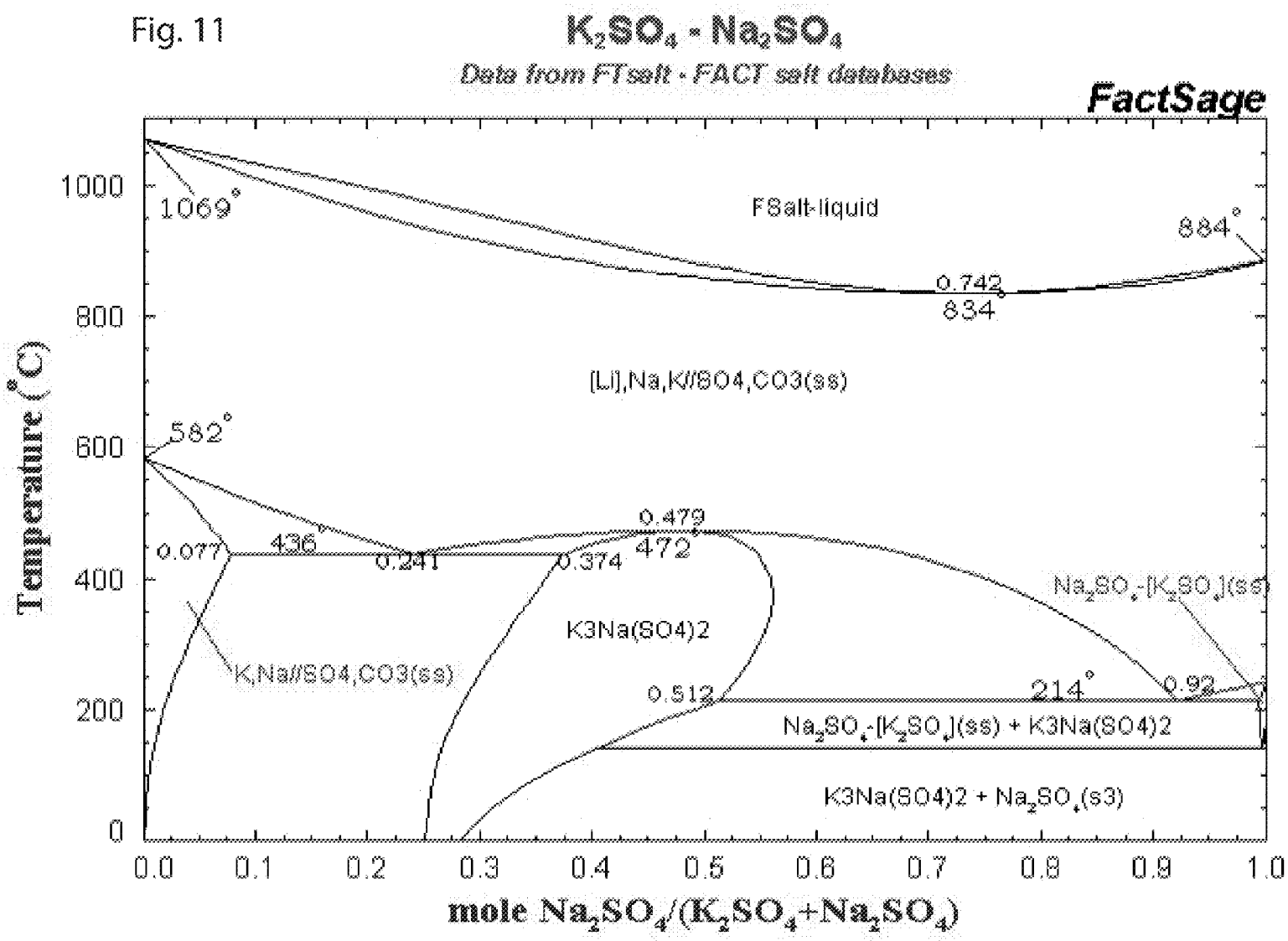
Figure 12:
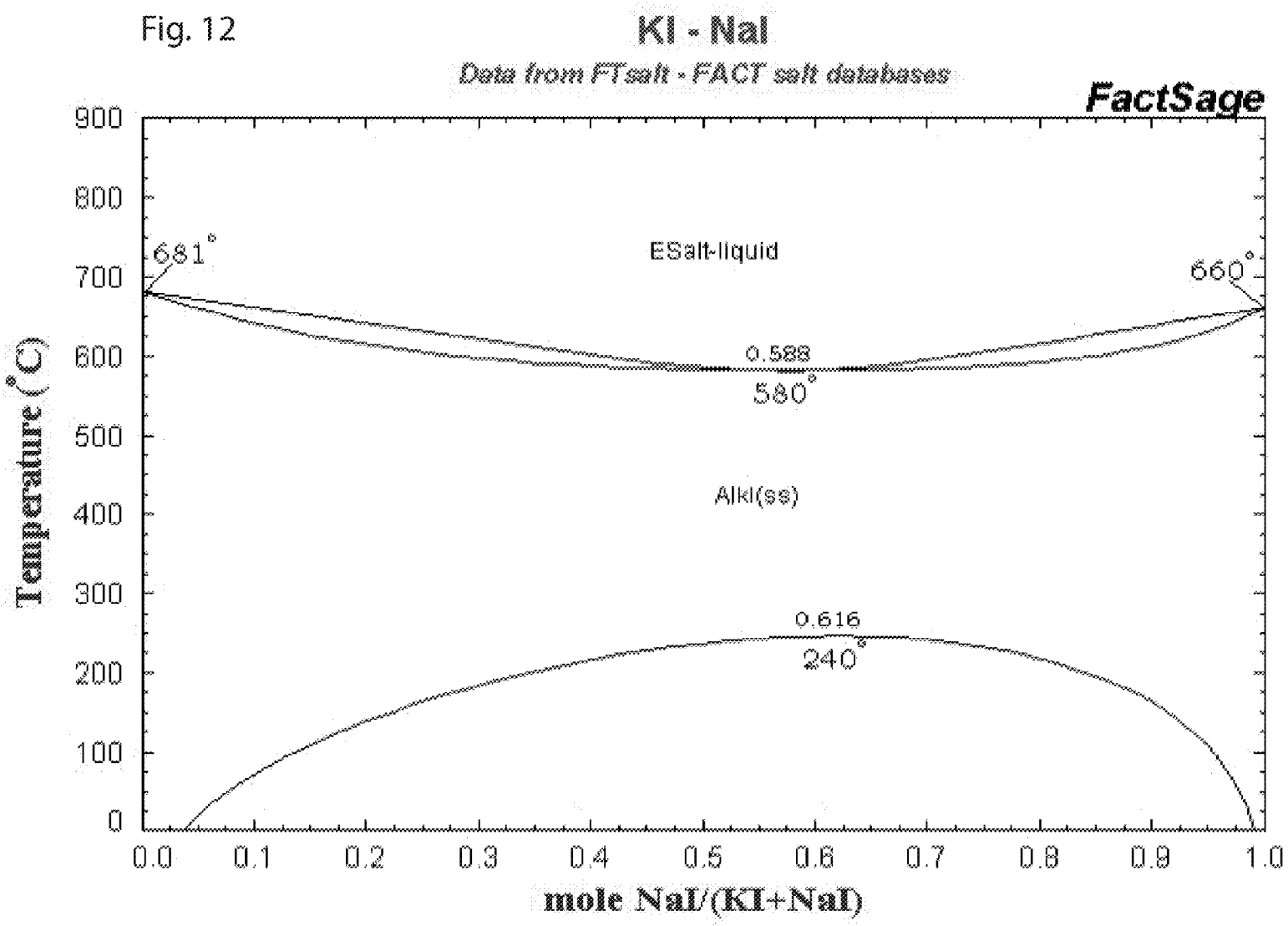
FIG. 12 is a graph of temperature versus mole concentration for the KI—NaI congruently melting salt alloy system.
Figure 13:
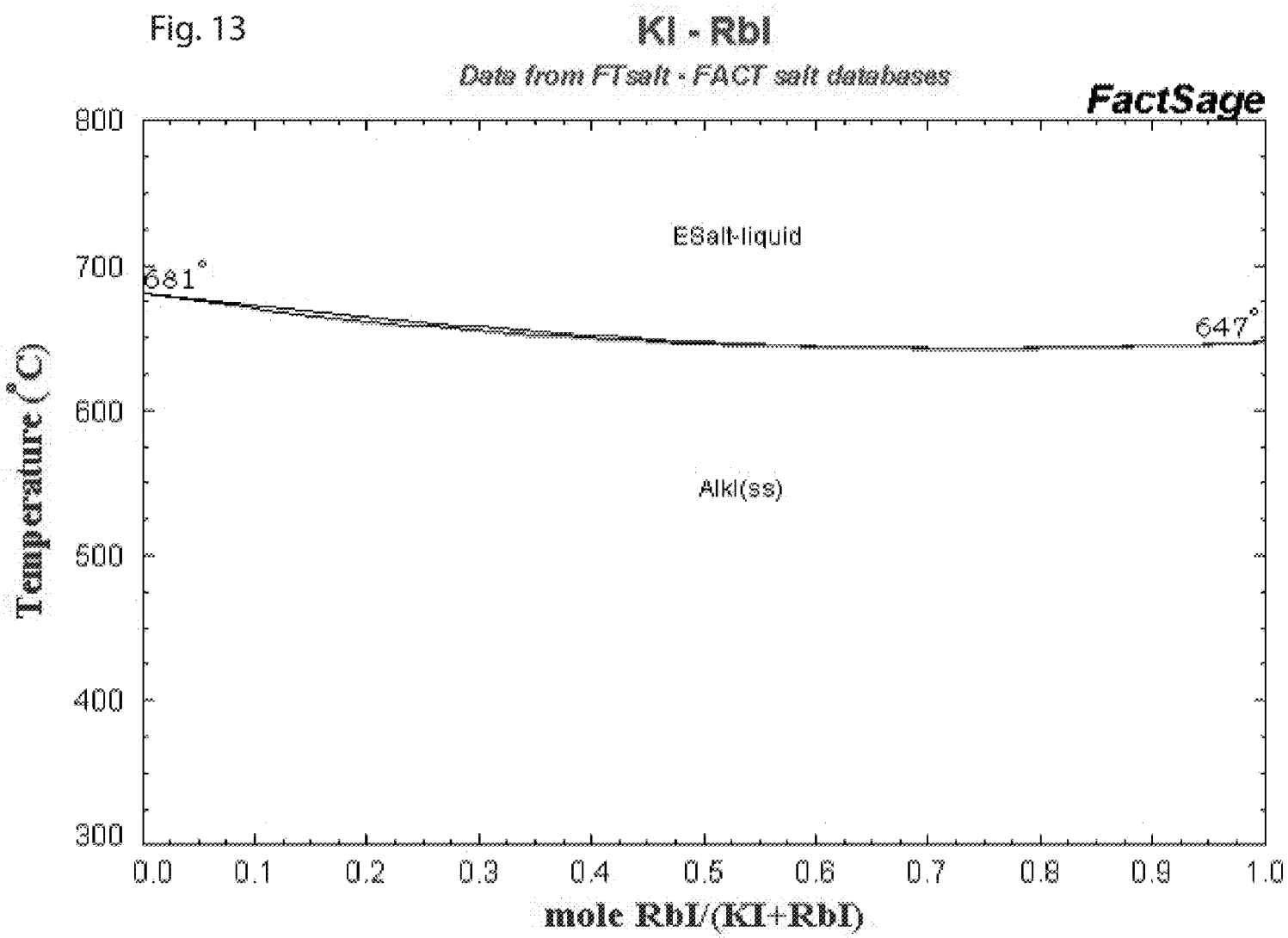
FIG. 13 is a graph of temperature versus mole concentration for the KI—RbI congruently melting salt alloy system.
Figure 14:
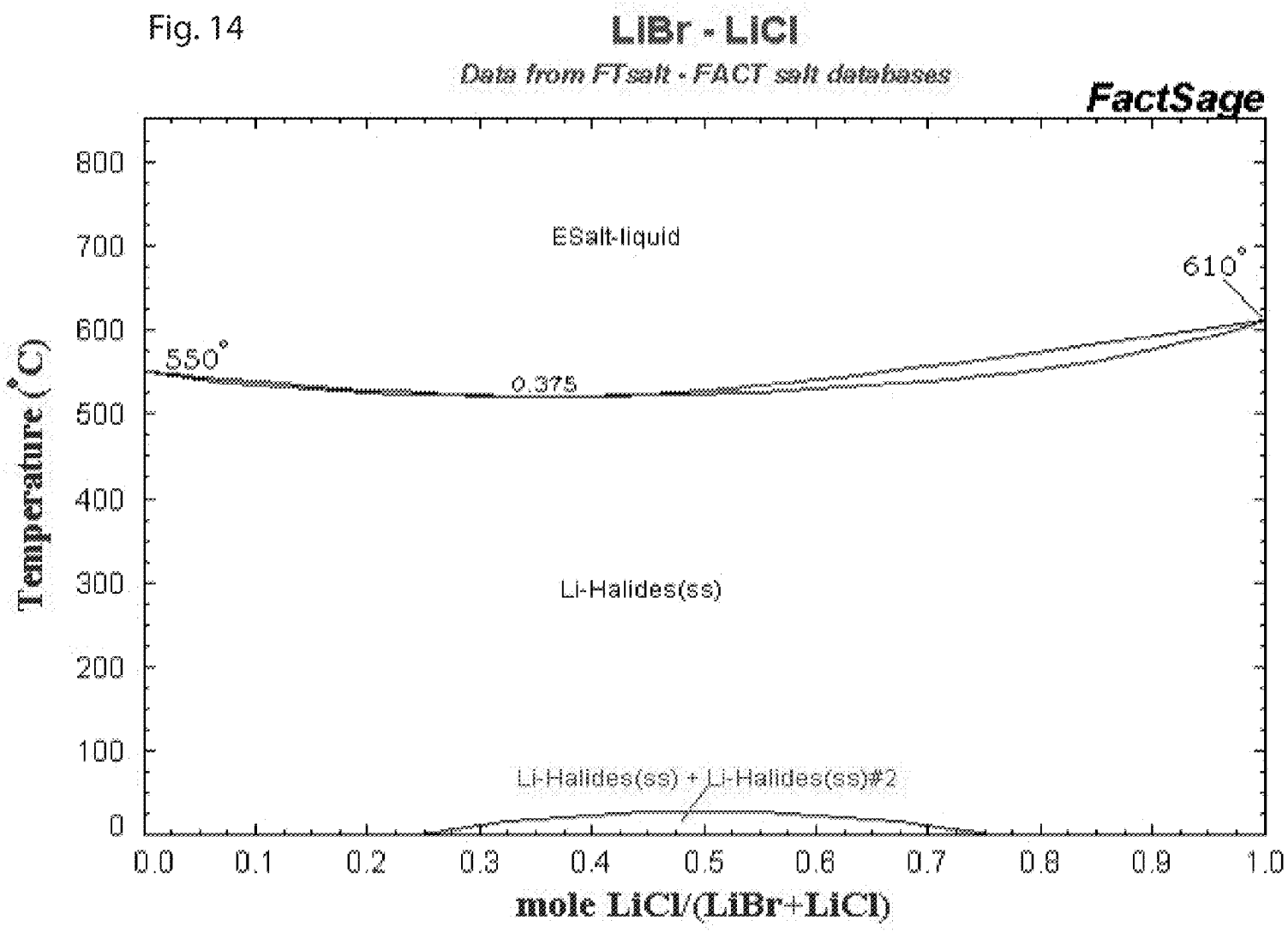
FIG. 14 is a graph of temperature versus mole concentration for the LiBr—LiCl congruently melting salt alloy system.
Figure 15:
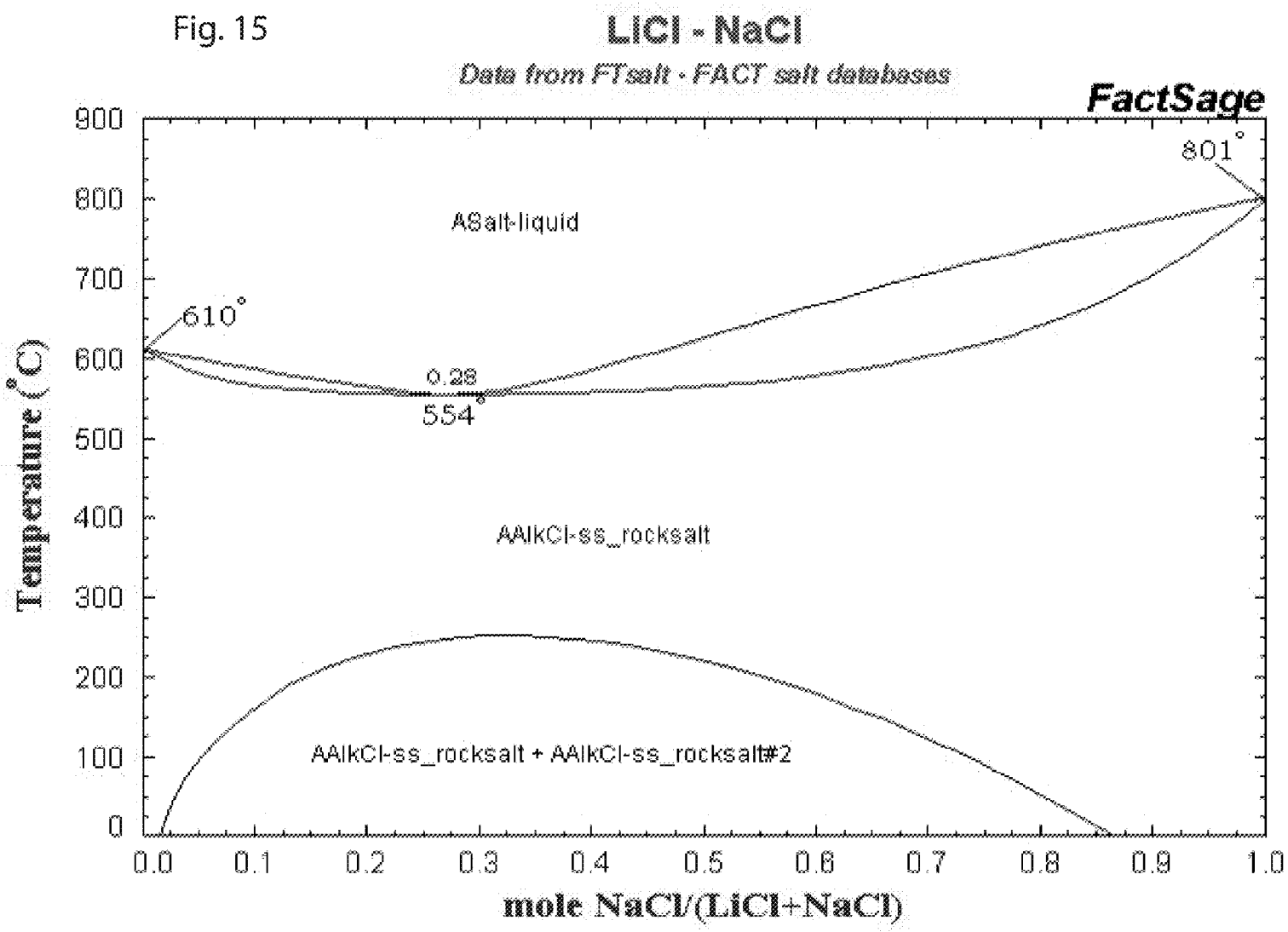
FIG. 15 is a graph of temperature versus mole concentration for the LiCl—NaCl congruently melting salt alloy system.
Figure 16:
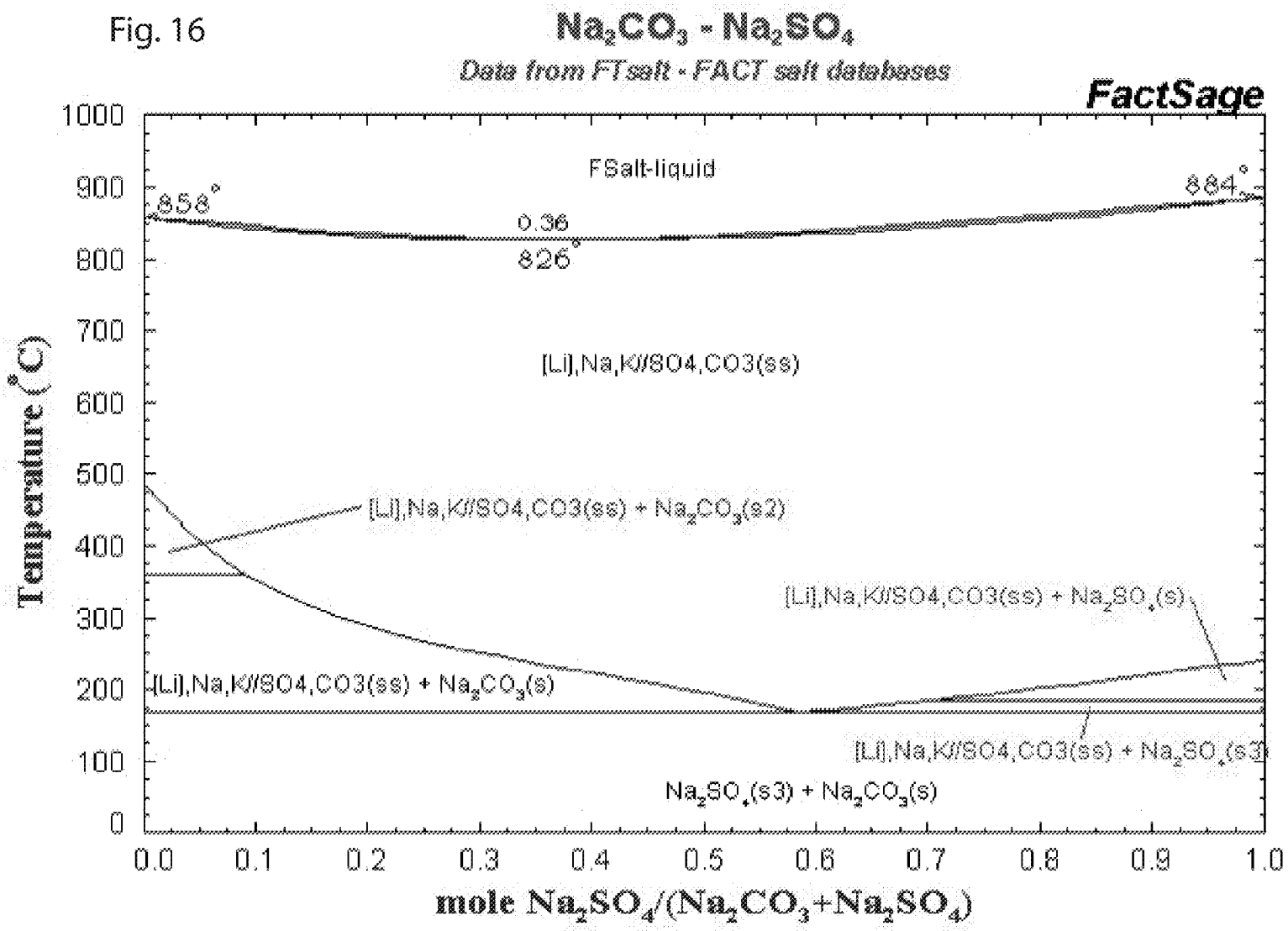
FIG. 16 is a graph of temperature versus mole concentration for the $Na_2CO_3$—$Na_2SO_4$ congruently melting salt alloy system.
Figure 17:
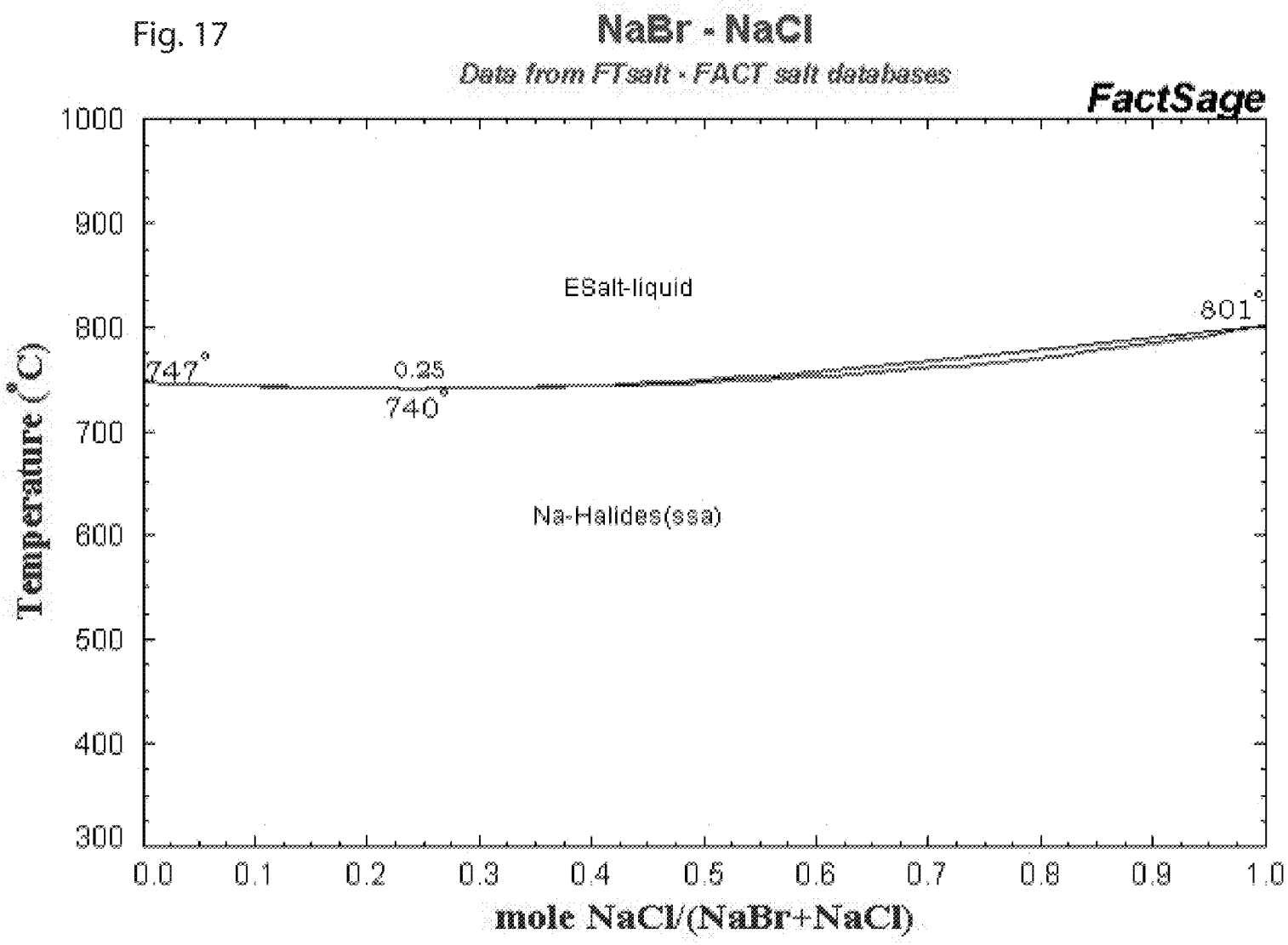
FIG. 17 is a graph of temperature versus mole concentration for the NaBr—NaCl congruently melting salt alloy system.
Figure 18:
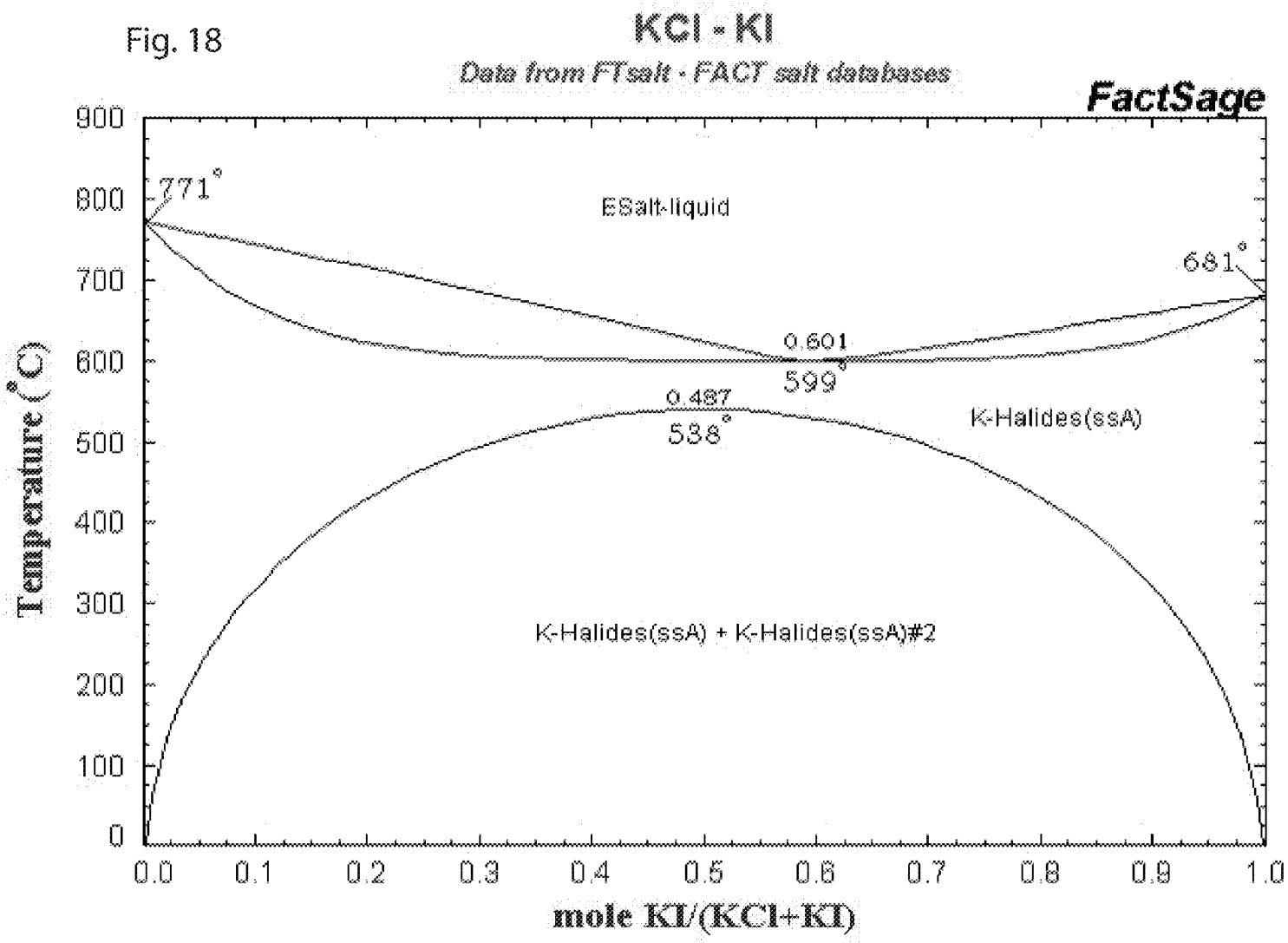
FIG. 18 is a graph of temperature versus mole concentration for the KCl—KI congruently melting salt alloy system.

The following table summarizes the identified congruent melting salt alloy systems, the melting point of systems' constituents and the congruent melting temperature and composition of the systems:

TABLE 1

| System | Melting Point [1st member] | Mole Fraction of the congruent melting alloy [congruent melting temperature] | Melting Point [2nd member] |
|---|---|---|---|
| KBr—KCl | 734 C. KBr | 0.35 KCl [717 C.] | 771 C. KCl |
| KBr—KI | 734 C. KBr | 0.67 KI [663 C.] | 681 C. KI |

TABLE 1-continued

| System | Melting Point [1st member] | Mole Fraction of the congruent melting alloy [congruent melting temperature] | Melting Point [2nd member] |
|---|---|---|---|
| KBr—NaBr | 734 C. KBr | 0.487 NaBr [643 C.] | 747 C. NaBr |
| KBr—RbBr | 734 C. RbBr | 0.75 RbBr [689 C.] | 694 C. RbBr |
| $CaCl_2$—$SrCl_2$ | 772 C. $CaCl_2$ | 0.416 $SrCl_2$ [662 C.] | 874 C. $SrCl_2$ |
| CsBr—CsI | 635 C. CsBr | 0.472 CsI [578 C.] | 640 C. CsI |
| CsCl—KCl | 645 C. CsCl | 0.375 KCl [616 C.] | 771 C. KCl |
| $CsNO_3$—$RbNO_3$ | 410 C. $CsNO_3$ | 0.825 $CsNO_3$ [290 C.] | 312 C. $RbNO_3$ |
| $K_2CO_3$—$Na_2CO_3$ | 901 C. $K_2CO_3$ | 0.59 $Na_2CO_3$ [709 C.] | 858 C. $Na_2CO_3$ |
| $K_2SO_4$—$Na_2SO_4$ | 1069 C. $K_2SO_4$ | 0.742 $Na_2SO_4$ [834 C.] | 884 C. $Na_2SO_4$ |
| KI—NaI | 681 C. KI | 0.588 NaI [580 C.] | 660 C. NaI |
| KI—RbI | 681 C. KI | 0.75 RbI [640 C.] | 647 C. RbI |
| LiBr—LiCl | 550 C. LiBr | 0.375 LiCl [525 C.] | 610 C. LiCl |
| LiCl—NaCl | 610 C. LiCl | 0.28 NaCI [554 C.] | 801 C. NaCl |
| $Na_2CO_3$—$Na_2SO_4$ | 858 C. $Na_2CO_3$ | 0.36 $Na_2SO_4$ [826 C.] | 884 C. $Na_2SO_4$ |
| KCl—NaCl | 771 C. KCl | 0.50 NaCl [660 C.] | 801 C. NaCl |
| NaBr—NaCl | 747 C. NaBr | 0.25 NaCl [740 C.] | 801 C. NaCl |
| KCl—KI | 771 C. KCl | 0.601 KI [599 C.] | 681 C. KI |

This application identifies congruent melting alloy salts that are more ductile than the pure salts because the crystal structure of congruent melting alloys can be considered as face centered cubic (FCC) closest packing of the larger chlorine anions, with the smaller sodium and potassium cations distributed only among the octahedral voids (with a coordination number of 6) in a random fashion that minimizes the strain energy created by the different sizes of the sodium and potassium cations, and not among the tetrahedral voids (with a coordination number of 4) which are too small for either sodium or potassium cations. The coordination number of an ionic crystal is the number of nearest ions of opposite charge. A coordination number of 8 is not compatible with a congruent melting alloy system. Thus, the ionic radius ratio of the cation and anion (i.e., r/R) for a congruent melting alloy is quite restricted in the range of about 0.414 to 0.732.

The above-identified congruently melting salt alloys of Table 1 do not have the properties of the component salts, but different alloy mechanical properties, and different from the properties that follow law of mixtures. Congruently melting salt alloys at 50% have cations randomly distributed on a face centered cubic (FCC) lattice. The randomly distributed cations in the 50% alloy salt have lower bond strength due to the lower melting point. This permits the congruently melting alloys to be more ductile or less brittle than either of the constituent pure salts. Further, because the cations randomly occupy the FCC lattice sites somewhat like an alloy metal, its coefficient of thermal expansion should be larger than the coefficient of thermal expansion of the component pure salts. At the congruent melting alloy point the 50% alloy should also have a lower solid density. Thus, the shrinkage at the lower "liquid to solid" transformation temperature, where there is no composition change, should produce a lower shrinkage than a eutectic alloy salt system because the solid density is lower and the liquid density is larger than the corresponding pure salt densities.

For example, the present application recognizes that sodium and potassium atoms must occupy octahedral voids (as opposed to tetrahedral voids with a coordination number [CN] of 4) because their coordination number is calculated as 6. That is, for Na and Cl, r[Na]/R[Cl]=0.95 A/1.81

A=0.53; likewise for K and Cl, r[K]/R[Cl]=1.33 A/1.81 A=0.73. Since the radius ratio is too small for 8:8 [0.732], the coordination number of Na & Cl in NaCl and K & Cl in KCl are 6:6. Accordingly, and as an example, at the congruent melting point of the NaCl—KCl system at 50% NaCl, the crystal structure is FCC with the closest packing of the larger Cl anions and the smaller Na and K cations distributed among the octahedral voids in a random fashion that minimizes the strain energy created by the different sizes of the Na and K cations. Thus, all the octahedral sites [CN=6] created with the FCC packing of the larger Cl anions are occupied while none of the smaller tetrahedral voids [CN=4] are occupied. As a result, the congruently melting alloy is predicted to be more ductile, and because of the lower bond strength (due to the lower melting point) should also have a higher coefficient of thermal expansion, lower solid density, higher liquid density and shrink less than either component salt, e.g. NaCl or KCl.

To select the optimal congruently melting salt alloys for use as salt cores in the casting of aluminum-silicon alloys, it is first recognized that the melting point of aluminum is 660° C. and the Al—Si eutectic temperature is 577° C. The melting point of aluminum and the eutectic temperature of the AlSi alloy is then compared to the congruent melting point of the salt system to ascertain whether the salt system can withstand the heat of the molten alloy. Several congruently melting alloys have congruent melting points too low for use with aluminum high pressure die castings because the congruent melting points are either lower than the AlSi eutectic temperature, i.e. $CsNO_3$—$RbNO_3$ at 290° C.; LiBr—LiCl at 525° C.; and LiCl—NaCl at 554° C. Others, with a congruent melting temperature lower than the melting point of aluminum, i.e. CsBr—CsI at 578° C.; CsCl—KCl at 616° C.; KI—NaCl at 580° C.; and KCl—KI at 599° C. may still be used, but are less optimal in aluminum silicon HPDC. Several of these lower congruent melting point salts may be used in other casting systems, particularly magnesium alloys having a eutectic temperature of 450° C. Further, while the other listed congruently melting salts meet the melting point requirements, they are less optimal for more practical reasons. For example, sulfates and carbonates of sodium and phosphorus produce congruent melting alloys having substantially higher congruent melting points than the melting point of aluminum and therefore require more energy investment. Likewise, the strontium in the CaCl2-SrCl2 system and rubidium in the RbBr and RbI systems are more expensive than necessary. Accordingly, the Na & K chlorides, bromides, and iodides are the most cost effective solutions, i.e. KBr—KCl, KBr—KI, KBr—NaBr, $K_2CO_3$—$Na_2CO_3$, KCl—NaCl, and NaBr—NaCl. Further, coordination number analysis indicates that the KI—NaCl system, KCl—NaBr system as well as the KBr—NaCl system will operate effectively as congruently melting salt alloys that may be used in creating salt cores in the casting of aluminum-silicon alloys.

Unlike the eutectic composition where the eutectic is a 50/50 mechanical mixture of the pure salts, the congruent melting alloy composition is a true alloy composition and the mechanical properties of this alloy composition is unrelated to the mechanical properties of the pure salts through the law of mixtures. As a result, solid density at the congruent alloy melting point, is less than the solid density at eutectic melting point temperature or at either pure salt melting points, because the bond strengths holding together the atoms of the pure salts are much larger than the bond strengths holding together congruent melting alloy of much lower melting point. This translates into a lower shrinkage for the congruent melting alloy than either of the two pure salts used to make the alloy salt, or a corresponding eutectic composition consisting of a mechanical mixture of the pure salts. Thus, congruent melting alloy shrinkage is lower than the shrinkage of a eutectic alloy of the same composition made up of the same pure salt constituents because its solid density is smaller and its molten density is higher, making the difference between these values smaller than its eutectic alloy counterpart.

In the available literature, shrinkage values of pure salts are somewhat limited, and the shrinkage values for eutectics in binary salt systems are almost non-existent. However, the densities of molten salt and molten binary salt systems are readily available. The density of most molten salts varies almost linearly with temperature and is represented by the equation: $d=a-bT/1000$ where d is the density [g/cc], a and b are constants, and T is the temperature in degrees Celsius over significant ranges of temperature, which may not include the melting point. The densities of the solid pure salts or solid alloy salts are available at room temperature but almost never available at the melting point in the solid state. Thus, the shrinkage value at the melting point is not available, except in rare instances. As a result, shrinkage values in this application were calculated for pure salts and eutectic salts using FIGS. 2-18 and 22, along with the available information from the literature. These calculations are listed in Table 2.

TABLE 2

Salts, CN, calculated molten MP d, RT d, shrinkage = [0.91 RT d − MP d]/MP d

| | CN = | a = | b = | Molten T Range = | MP = | Calculated Molten d = | (g/cm3) | Shrinkage = |
|---|---|---|---|---|---|---|---|---|
| CaCl2* | 6 | 2.4108 | 0.4225 | 787 to 950 C. | 782 C. | 2.08 g/cm3 | MP d = 2.15 g/cm3 | 3.4% |
| CaF2 | 6/8 | 3.072 | 0.391 | 1367 to 2027 C. | 1360 C. | 2.54 g/cm3 | RT d = 3.18 g/cm3 | 13.9% |
| CBr | 8 | 3.911 | 1.22 | MP to 860 C. | 636 C. | 3.14 g/cm3 | RT d = 4.43 g/cm3 | 28.4% |
| CsCl* | 8 | 3.479 | 1.065 | 667 to 907 C. | 646 C. | 2.79 g/cm3 | RT d = 3.99 g/cm3 | 30.1% |
| CsF | 12 | 4.549 | 1.2806 | 712 to 912 C. | 682 C. | 3.68 g/cm3 | RT d = 4.12 g/cm3 | 1.9% |
| CsI* | 8/6 | 3.918 | 1.18 | 645 to 855 C. | 621 C. | 3.19 g/cm3 | RT d = 4.51 g/cm3 | 28.7% |
| KBr | 6 | 2.733 | 0.825 | 747 to 927 C. | 730 C. | 2.13 g/cm3 | RT d = 2.75 g/cm3 | 17.5% |
| KCl* | 6 | 1.977 | 0.583 | 777 to 947 C. | 776 C. | 1.52 g/cm3 | MP d = 1.79 g/cm3 | 17.8% |
| K2CO3* | | 2.293 | 0.442 | 907 to 1007 C. | 891 C. | 1.90 g/cm3 | RT d = 2.43 g/cm3 | 16.4% |
| KF | 8/12 | 2.469 | 0.652 | 881 to 1037 C. | 846 C. | 1.92 g/cm3 | MP d = 2.24 g/cm3 | 16.6% |
| KI* | 6 | 3.099 | 0.956 | 682 to 904 C. | 686 C. | 2.4 g/cm3 | RT d = 3.13 g/cm3 | 16.7% |
| LiBr* | 6 | 2.888 | 0.652 | MP to 740 C. | 547 C. | 2.53 g/cm3 | RT d = 3.46 g/cm3 | 24.5% |
| LiCl* | 6 | 1.766 | 0.433 | 627 to 777 C. | 614 C. | 1.50 g/cm3 | MP d = 1.90 g/cm3 | 26.4% |
| Li2CO3 | | 2.10 | 0.373 | 737 to 847 C. | 723 C. | 1.83 g/cm3 | RT d = 2.11 g/cm3 | 4.9% |
| LiF | 4 | 2.224 | 0.490 | 876 to 1047 C. | 842 C. | 1.81 g/cm3 | MP d = 2.34 g/cm3 | 29.4% |

TABLE 2-continued

Salts, CN, calculated molten MP d, RT d, shrinkage = [0.91 RT d − MP d]/MP d

| | CN = | a = | b = | Molten T Range = | MP = | Calculated Molten d = | (g/cm3) | Shrinkage = |
|---|---|---|---|---|---|---|---|---|
| LiI | 4 | 3.540 | 0.918 | MP to 670 C. | 460 C. | 3.13 g/cm3 | RT d = 3.49 g/cm3 | 11.5% |
| MgCl2 | 4 | 1.894 | 0.302 | 727 to 967 C. | 708 C. | 1.68 g/cm3 | RT d = 2.32 g/cm3 | 25.7% |
| MgF2 | 6 | 3.092 | 0.524 | 1377 to 1827 C. | 1266 C. | 2.43 g/cm3 | RT d = 3.0 g/cm3 | 12.3% |
| NaBr* | 6 | 2.952 | 0.817 | MP to 945 C. | 755 C. | 2.34 g/cm3 | RT d = 3.20 g/cm3 | 24.4% |
| NaCl* | 6 | 1.991 | 0.543 | 803 to 1030 C. | 801 C. | 1.56 g/cm3 | MP d = 1.95 g/cm3 | 24.7% |
| NaCO3* | | 2.357 | 0.449 | 867 to 1007 C. | 851 C. | 1.97 g/cm3 | RT d = 2.53 g/cm3 | 16.9% |
| NaF | 6 | 2.502 | 0.560 | 997 to 1057 C. | 988 C. | 1.95 g/cm3 | RT d = 2.56 g/cm3 | 19.5% |
| NaI* | 6 | 3.368 | 0.949 | MP to 915 C. | 651 C. | 2.75 g/cm3 | RT d = 3.67 g/cm3 | 21.4% |
| RbBr* | 8/6 | 3.446 | 1.072 | 700 to 910 C. | 682 C. | 2.71 g/cm3 | RT d = 3.35 g/cm3 | 12.5% |
| RbCl | 8 | 2.880 | 0.883 | MP to 925 C. | 715 C. | 2.25 g/cm3 | RT d = 2.80 g/cm3 | 13.2% |
| RbF | 12 | 3.707 | 1.011 | 820 to 1005 C. | 775 C. | 2.92 g/cm3 | RT d = 3.56 g/cm3 | 10.9% |
| RbI* | 6 | 3.638 | 1.14 | 655 to 905 C. | 642 C. | 2.91 g/cm3 | RT d = 3.55 g/cm3 | 11.0% |
| SrCl2* | 8 | 3.232 | 0.578 | 893 to 1037 C. | 873 C. | 2.73 g/cm3 | RT d = 3.05 g/cm3 | 1.7% |
| SrF2 | 8 | 4.579 | 0.751 | 1477 to 1927 C. | 1450 C.+ | 3.49 g/cm3 | RT d = 4.24 g/cm3 | 10.6% |

Applicants discovered that at the congruent melting point in the congruently melting salt alloy systems, the bond strength and density in the solid state is less than the bond strength and densities of either pure component salt in the solid state. This is because applicants realized that the congruent melting point is going to be less than the melting point of either component salt melting point. Further, the density at the congruent melting point in the liquid state is higher than the densities at the melting points of the salt components in the liquid state because the congruent melting point is lower than the melting points of either of the component salts. Further, ionic solids with high melting points will have strong bonds as reflected in a relatively higher density in the solid state, while ionic solids with low melting points will have weak bonds reflected in a relatively lower density in the solid state. Because of low melting points compared with the component pure salts, congruently melting alloy salts should have low strength bounds and lower densities in the solid state. Accordingly, the congruently melting alloy has a lower shrinkage than the pure salts that were used to make the congruent melting alloy.

The identified congruently melting salt alloys can optimally be used in for an expendable salt core in high pressure die casting (HPDC). Using congruently melting salt alloys provides a benefit of the salt core undergoing no change in composition on freezing, melting and freezing isothermally, exhibiting no coring in its cast structure, and having a relatively low shrinkage compared to conventional pure salt cores. As explained, the identified binary isomorphous salt systems where the liquidus and solidus interfaces of the respective constituents do not descend continuously from the melting temperature of one salt to that of the other but, instead, passes through a minimum temperature, that lies below the melting point of both salt components are advantageous. This is because the liquidus and solidus interfaces of the respective constituencies meet at the congruent melting point. Such congruent melting salt alloys do not have "law of mixtures" properties of the component pure salts, but different alloy mechanical properties, unrelated to the component pure salts, as detailed above. Particularly, because the liquid density is higher than the pure salts and the solid density is less than the pure salts, the shrinkage is less than the shrinkage of a eutectic alloy of the same composition and temperature. This provides a real advantage in that this reduction in shrinkage prevents cracking of the core that negatively affects the rejection rate of the HPDC cored parts. In other words, salt cores having reduced shrinkage values will result in HPDC that have significantly less flaws in the cavities firmed by the salt cores.

In one embodiment, the congruently melting salt alloy is used for salt cores in the HPDC process for aluminum alloys. The salt cores may be fused salt cores used to make closed deck engine blocks or other complicated die cast parts. While each of the congruently melting salt alloys identified above may be advantageously used, the following systems provide both practical advantages in having reduced shrinkage and also lower cost production: the KBr—KCl system at 0.35 mole fraction KCl with a congruent melting temperature of 717° C.; the KBr—KI system at 0.67 mole fraction KI with a congruent melting temperature of 663° C.; the KBr—NaBr system at 0.487 mole fraction NaBr with a congruent melting temperature of 643° C.; the NaBr—NaCl system at 0.25 mole fraction NaCl with a congruent melting temperature of 780° C.; the $K_2CO_3$—$Na_2CO_3$ system at 0.59 mole fraction $Na_2CO_3$ and with a congruent melting temperature of 709° C.; the KCl—NaCl system at 0.50 mole fraction KCl and with a congruent melting temperature of 660° C.; the KCl—NaBr system at mole fraction 0.50 KCl with a congruent melting temperature of 750° C. or lower; or the KBr—NaCl system at mole fraction 0.50 KBr with a congruent melting temperature of 730° C. or lower. If cost advantages are not a consideration, the KBr—RbBr system at 0.75 mole fraction RbBr with a congruent melting temperature of 689° C.; the $CaCl_2$—$SrCl_2$ system at 0.416 mole fraction $SrCl_2$ and with a congruent melting temperature of 662° C.; the $K_2SO_4$—$Na_2SO_4$ at 0.74 mole fraction $Na_2SO_4$ and with a congruent melting point of 834° C.; the $Na_2CO_3$—$Na_2SO_4$ at 0.36 mole fraction $Na_2SO_4$ with a congruent melting point at 826° C.; or the KI—RbI system at 0.75 mole fraction RbI and with a congruent melting temperature of 834° C. may also be used with the same advantages in increased strength and ductility on the final product. Further, the following systems may also be used, but are not as optimal as those listed above because of the proximity of the melting point of aluminum to the congruent melting point: the CsCl—KCl system at 0.375 mole fraction KCl and with a congruent melting temperature of 616° C. and the KCl—KI system at 0.601 mole fraction KI and with a congruent melting temperature of 599° C.

In another embodiment, the congruently melting salt alloy is used for salt cores in the HPDC process for magnesium alloys. Like aluminum alloys, the magnesium alloys may be used to make closed deck engine blocks or other complicated die cast parts with the identified salt cores. While each of the congruently melting salt alloys identified above for aluminum alloys may be advantageously used, the following systems may also be used a will also provide both practical advantages in having reduced shrinkage and also lower cost production for magnesium alloys: the KI—NaI system at 0.588 mole fraction NaI and with a congruent melting temperature of 580° C.; the KI—NaCl system at 0.5 mole fraction NaCl with a congruent melting temperature of 560° C.; the LiBr—LiCl system at 0.375 mole fraction LiCl with a congruent melting temperature of 525° C.; and the LiCl—NaCl system at 0.28 mole fraction NaCl with a congruent melting temperature of 554° C. If cost advantages are not a consideration, the CsBr—CsI system at 0.472 mole fraction CsI with a congruent melting temperature of 578° C.; the CsCl—KCl system at 0.375 mole fraction KCl with a congruent melting temperature of 580° C. may also be used for magnesium alloy HPDC castings.

In the embodiments noted above, one of ordinary skill in the art will recognize that because the liquidus and solidus are relatively flat at the congruent melting point, the congruent alloy composition listed may be plus or minus 0.05 mole fraction of the mole fraction identified. Further, the identified melting points may be plus or minus 5° C. because the identified melting points were calculated and determined both theoretically and experimentally. Additionally, salt cores for either aluminum or magnesium castings can provide additional utility when they are not allowed to cool below 200° C. after casting, and are transferred to an oven at 200° C. to improve the congruent melting alloy's resistance to exhibiting cracks in the salt core.

EXAMPLE

Figure 19:
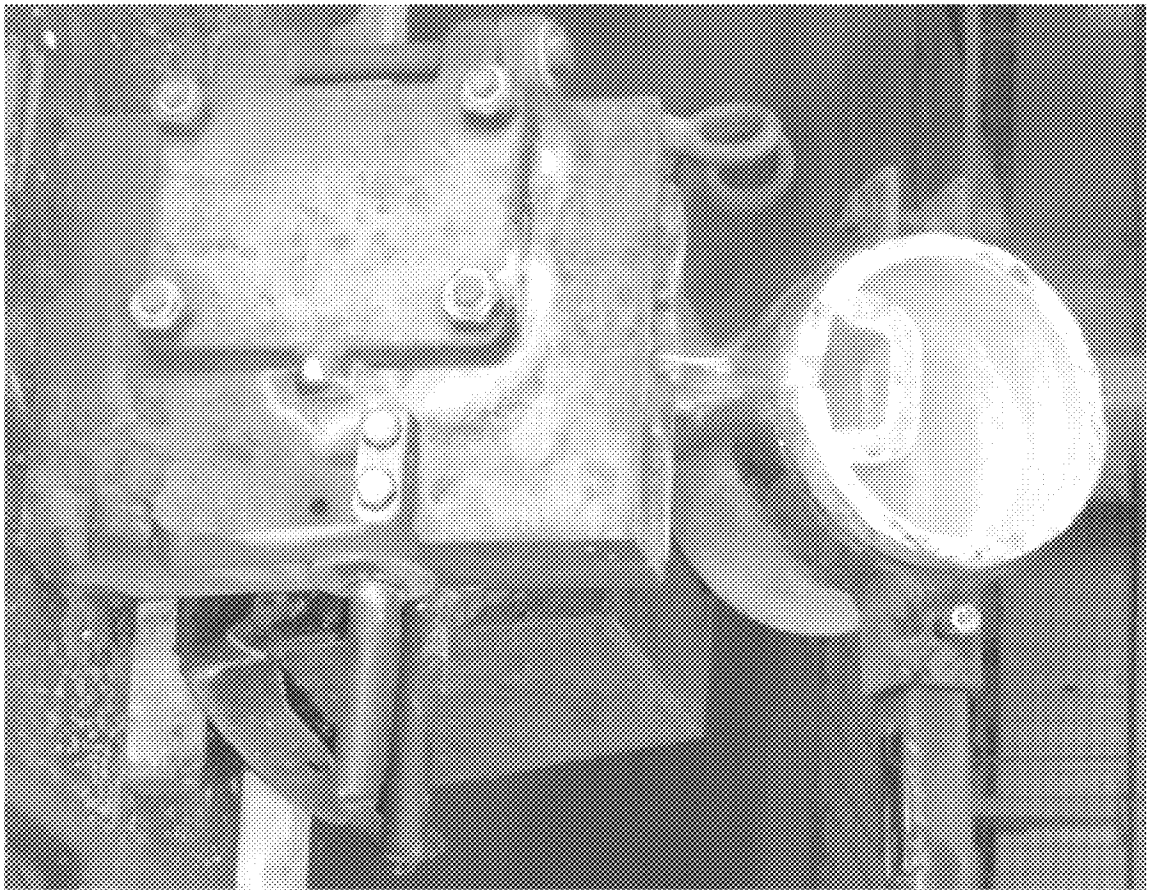
FIG. 19 is a photograph demonstrating the permanent metal mold used to create the samples for Example 1.
Figure 20:
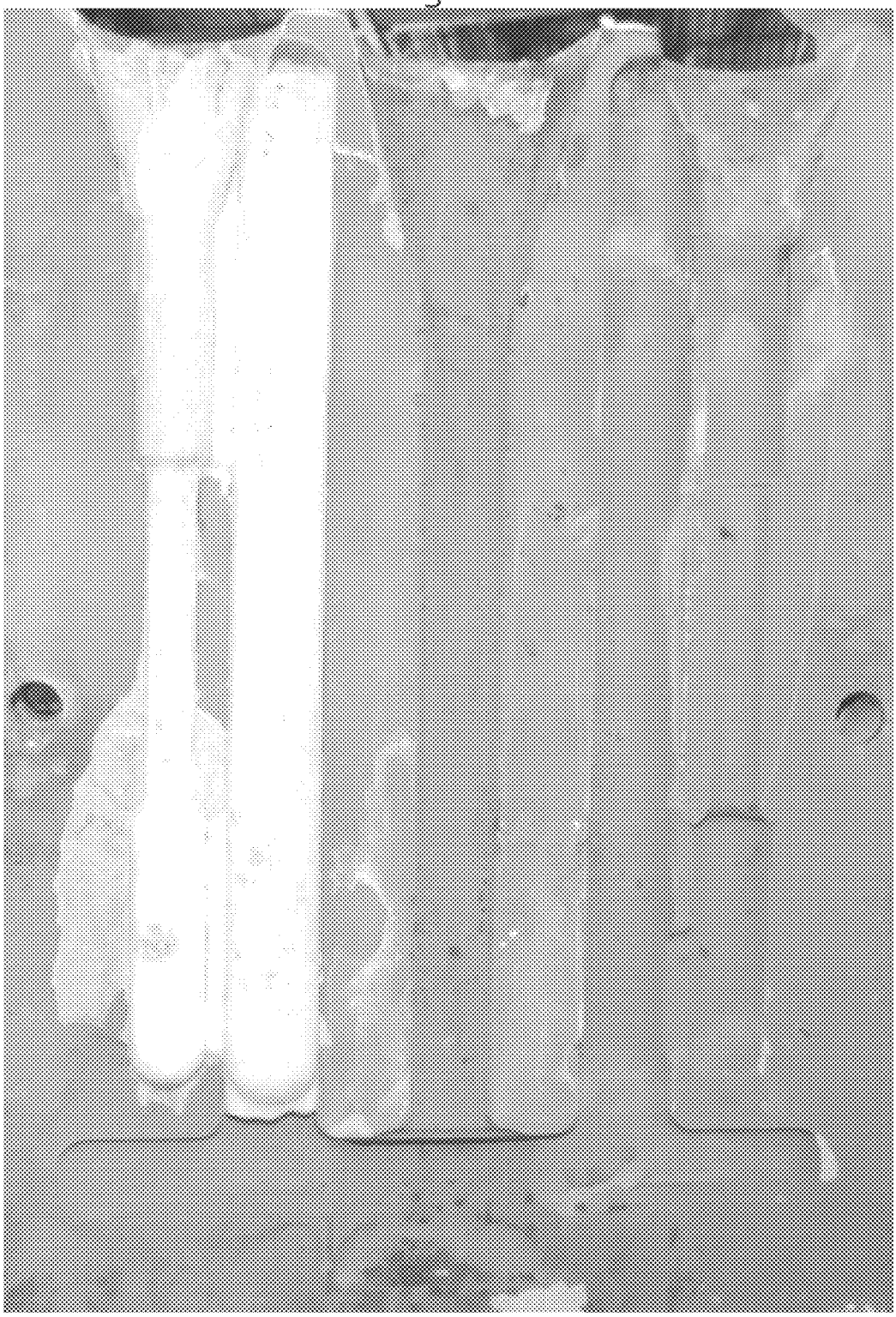
FIG. 20 is a photograph demonstrating solidified salt cores provided with a congruently melting alloy in accordance with the present invention.
Figure 21:
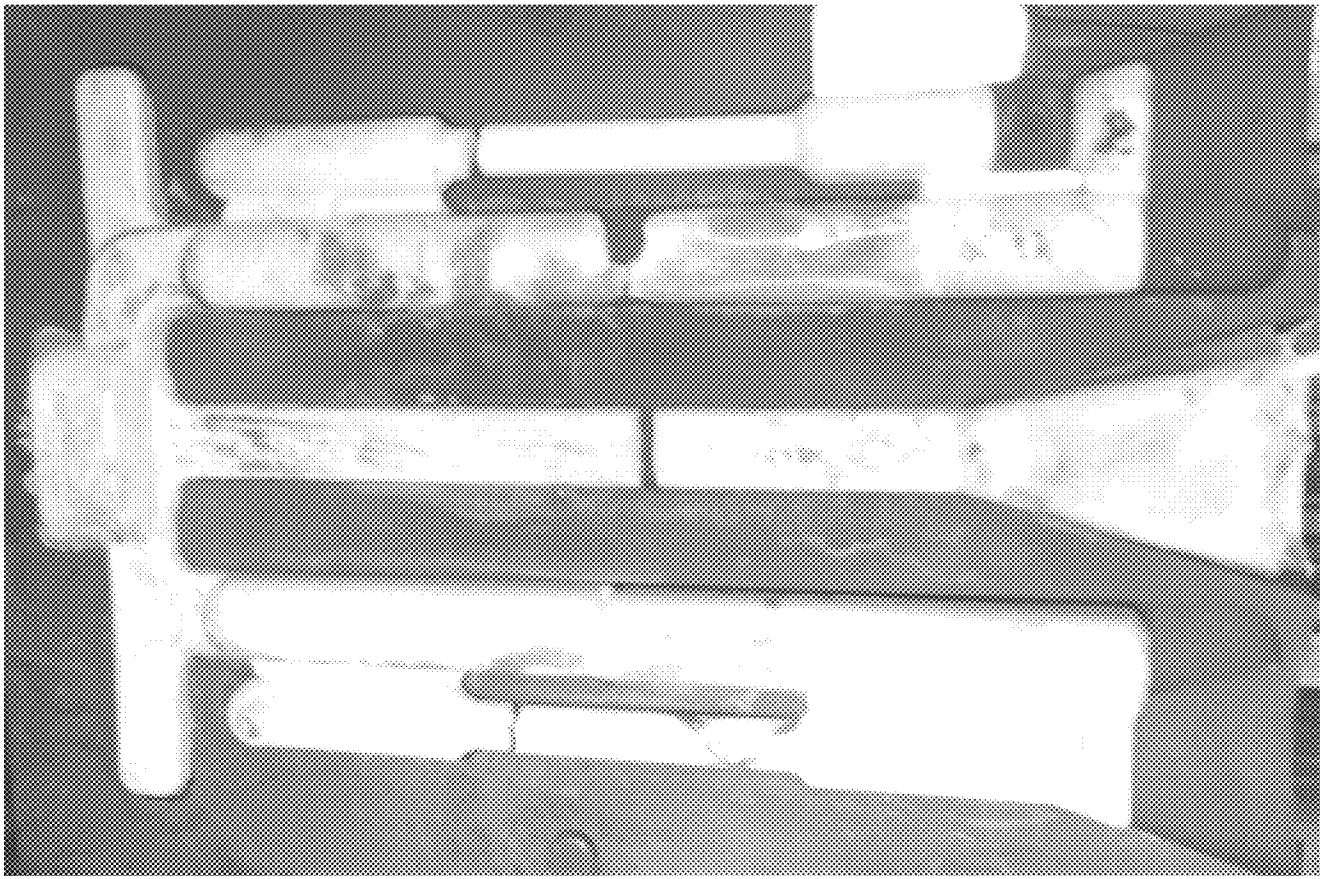
FIG. 21 is a photograph demonstrating solidified salt cores poured with a traditional eutectic salt alloy NaCl—$Na_2CO_3$ and demonstrating the cracking problem prevalent due to shrinkage with traditional salt cores.
Figure 22:
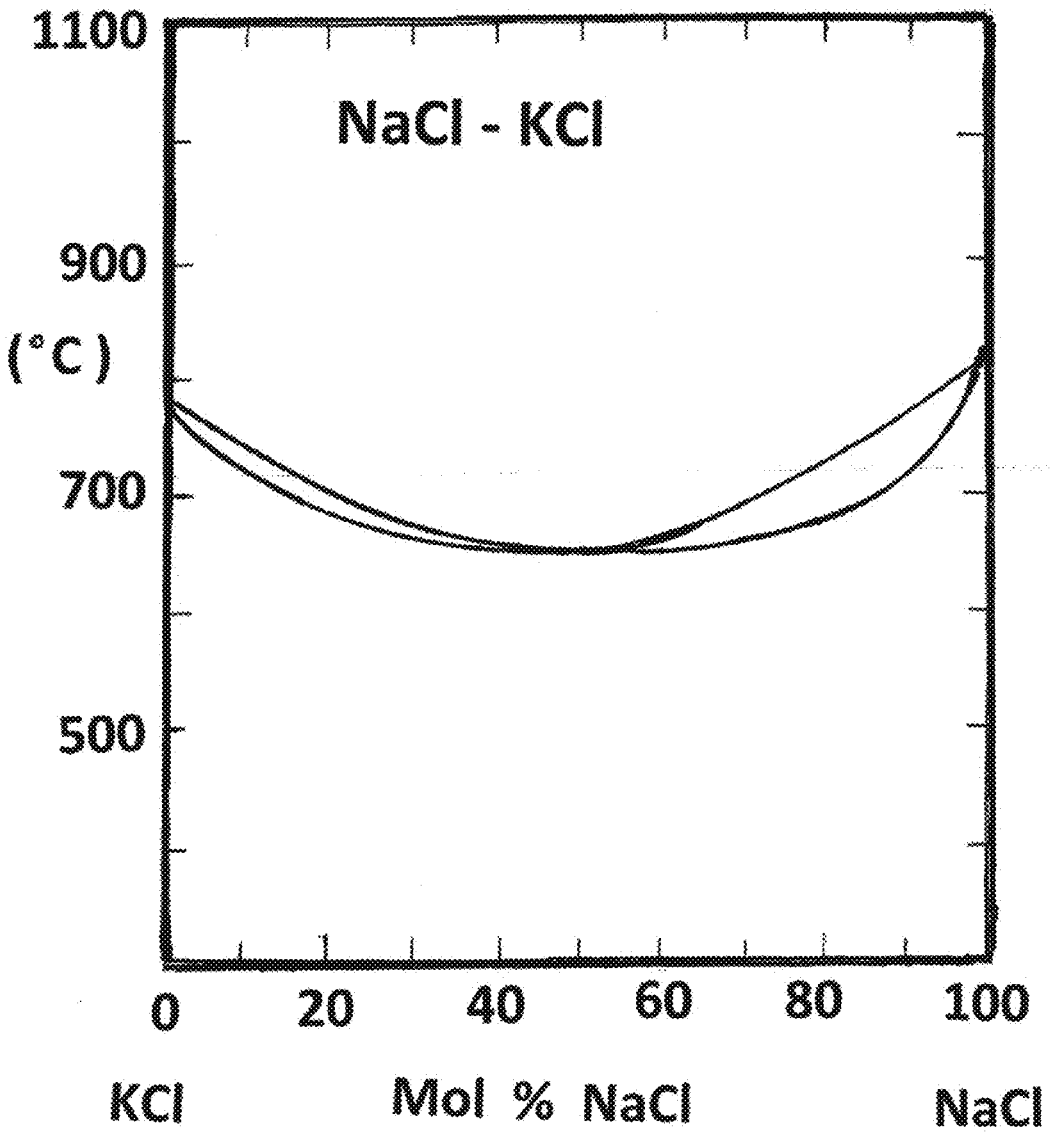
FIG. 22 is a graph of temperature versus mole concentration for the NaCl—KCl congruently melting salt alloy system.

The congruent melting alloy system of NaCl—KCl with a congruent melting alloy of 0.50 mole function NaCl at 685° C. or 56.1% by weight KCl was used to experimentally create salt core tensile specimens for comparative purposes with traditional salt cores. Twenty specimens of each of the congruent melting alloy cores and the traditional salt cores were made in the metal mold of FIG. 19. The salt cores constructed were tensile feeder bars, larger diameter feeder bars, and downward space extensions with rectangular cross sections as shown in FIGS. 20 and 21. The mold was preheated to 260° C. before the molten salt alloy was poured into the mold. The conventional salt cores used were the "standard of the industry" NaCl—$Na_2CO_3$ system (FIG. 1) at the eutectic composition, while the congruent melting alloy cores were constructed from the NaCl—KCl system (FIG. 22) at the congruent melting point composition.

Because of the large shrinkage contraction at the eutectic composition, the tensile bar salt core, the larger diameter feeder bar salt cores and the downward sprue extension salt cores with a rectangular cross section, when poured with the traditional NaCl—$Na_2CO_3$ salt, all cracked in the mold after pouring and solidification, as shown by example in FIG. 21. This cracking of the traditional eutectic alloy has constantly been obtained over the years with the NaCl—$Na_2CO_3$ system whether the pouring temperature was high at 1500° F. or low in the semi-solid state. Further, as FIG. 21 indicates, a significant gap between the cracked surfaces of each of the twenty specimens for the traditional eutectic alloy was observed.

By contrast, and independent of the casting temperature, the tensile bar, larger diameter feeder bars and sprue segment salt cores powered with the congruently melting alloy salt did not exhibit cracking in the solidified structures as shown in FIG. 20. These visual differences between the two compositions clearly indicate that the congruently melting alloy has a lower shrinkage value. In the above description, certain terms have been used for brevity, clarity and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. While each of the method claims includes a specific series of steps for accomplishing certain processes, the scope of this disclosure is not intended to be bound by the literal order or literal content of the steps described herein, and non-substantial differences or changes still fall within the scope of the disclosure.

What is claimed is:

1. A high pressure die casting salt core for use in a high pressure die casting process, the salt core comprising a congruently melting salt alloy system selected from one of the following congruently melting salt alloys: KBr—KCl at 0.30 to 0.40 mole fraction KCl; KBr—KI at 0.62 to 0.72 mole fraction KI; KBr—NaBr at 0.44 to 0.54 mole fraction NaBr; KBr—RbBr at 0.70 to 0.80 mole fraction RbBr, $CaCl_2$—$SrCl_2$ at 0.37 to 0.47 mole fraction $SrCl_2$; CsBr—CsI at 0.42 to 0.52 mole fraction CsI; CsCl—KCl at 0.32 to 0.42 mole fraction KCl; $CsNO_3$—$RbNO_3$ at 0.77 to 0.87 mole fraction $CsNO_3$; $K_2CO_3$—$Na_2CO_3$ at 0.54 to 0.64 mole fraction $Na_2CO_3$; $K_2SO_4$—$Na_2SO_4$ at 0.69 to 0.79 mole fraction $Na_2SO_4$; KI—NaI at 0.53 to 0.63 mole fraction NaI; KI—NaCl at 0.45 to 0.55 mole fraction NaCl; KI—RbI at 0.70 to 0.80 mole fraction RbI; LiBr—LiCl at 0.32 to 0.42 mole fraction LiCl; LiCl—NaCl at 0.23 to 0.33 mole fraction NaCl; $Na_2CO_3$—$Na_2SO_4$ at 0.31 to 0.41 mole fraction $Na_2SO_4$; KCl—NaCl at 0.45 to 0.55 mole fraction NaCl; NaBr—NaCl at 0.20 to 0.30 mole fraction NaCl; KCl—KI at 0.55 to 0.65 mole fraction KI; KCl—NaBr at 0.45 to 0.55 mole fraction KCl or KBr—NaCl at 0.45 to 0.55 mole fraction KBr.

2. The salt core of claim 1, wherein the high pressure die casting process is an aluminum alloy high pressure die casting process and the congruently melting salt alloy system is one of the following alloys KBr—KCl at 0.30 to 0.40 mole fraction KCl; KBr—KI at 0.62 to 0.72 mole fraction KI; KBr—NaBr at 0.44 to 0.54 mole fraction NaBr; KBr—RbBr at 0.70 to 0.80 mole fraction RbBr; $CaCl_2$—$SrCl_2$ at 0.37 to 0.47 mole fraction $SrCl_2$; CsBr—CsI at 0.42 to 0.52 mole fraction CsI; CsCl—KCl at 0.32 to 0.42 mole fraction KCl; $K_2CO_3$—$Na_2CO_3$ at 0.54 to 0.64 mole fraction $Na_2CO_3$; $K_2SO_4$—$Na_2SO_4$ at 0.69 to 0.79 mole fraction $Na_2SO_4$; LiBr—LiCl at 0.32 to 0.42 mole fraction LiCl; LiCl—NaCl at 0.23 to 0.33 mole fraction NaCl; KI—NaI at 0.53 to 0.63 mole fraction NaI; KI—RbI at 0.70 to 0.80 mole fraction RbI; $Na_2CO_3$—$Na_2SO_4$ at 0.31 to 0.41 mole fraction $Na_2SO_4$; KCl—NaCl at 0.45 to 0.55 mole fraction NaCl; NaBr—NaCl at 0.20 to 0.30 mole fraction NaCl; KCl—KI at 0.55 to 0.65 mole fraction KI; KCl—NaBr at 0.45 to 0.55 mole fraction KCl or KBr—NaCl at 0.45 to 0.55 mole fraction KBr.

3. The salt core of claim 2, wherein the high pressure die casting process is an aluminum alloy high pressure die casting process and the congruently melting salt alloy system is one of the following alloys: KBr—KCl at 0.30 to 0.40 mole fraction KCl; KBr—KI at 0.62 to 0.72 mole fraction KI; KBr—NaBr at 0.44 to 0.54 mole fraction NaBr; NaBr—NaCl at 0.20 to 0.30 mole fraction NaCl; $K_2CO_3$-$Na_2CO_3$ at 0.54 to 0.64 mole fraction $Na_2CO_3$; KCl—NaCl at 0.45 to 0.55 mole fraction NaCl; KCl—NaBr at 0.45 to 0.55 mole fraction KCl; or KBr—NaCl at 0.45 to 0.55 mole fraction KBr.

4. The salt core of claim 3, wherein the salt core is a fused salt core and forms internal passages in a cast part.

5. The salt core of claim 4, wherein the internal passages are in a closed deck engine block.

6. The salt core of claim 2, wherein the salt core alloy has a shrinkage value less than a shrinkage value for a eutectic salt mixture.

7. The salt core of claim 2, wherein the salt core alloy has a shrinkage value less than either of the two pure salts that comprise the alloy.

8. The salt core of claim 1, wherein the high pressure die casting process is a magnesium alloy high pressure die casting process and the congruently melting salt alloy system is one of the following alloys KBr—KCl at 0.30 to 0.40 mole fraction KCl; KBr—KI at 0.62 to 0.72 mole fraction KI; KBr—NaBr at 0.44 to 0.54 mole fraction NaBr; KBr—RbBr at 0.70 to 0.80 mole fraction RbBr; $CaCl_2$—$SrCl_2$ at 0.37 to 0.47 mole fraction $SrCl_2$; CsBr—CsI at 0.42 to 0.52 mole fraction CsI; CsCl—KCl at 0.32 to 0.42 mole fraction KCl; $K_2CO_3$—$Na_2CO_3$ at 0.54 to 0.64 mole fraction $Na_2CO_3$; $K_2SO_4$—$Na_2SO_4$ at 0.69 to 0.79 mole fraction $Na_2SO_4$; LiBr—LiCl at 0.32 to 0.42 mole fraction LiCl; LiCl—NaCl at 0.23 to 0.33 mole fraction NaCl; KI—NaI at 0.53 to 0.63 mole fraction NaI; KI—RbI at 0.70 to 0.80 mole fraction RbI; $Na_2CO_3$—$Na_2SO_4$ at 0.31 to 0.41 mole fraction $Na_2SO_4$; KCl—NaCl at 0.45 to 0.55 mole fraction NaCl; NaBr—NaCl at 0.20 to 0.30 mole fraction NaCl; KCl—KI at 0.55 to 0.65 mole fraction KI; KCl—NaBr at 0.45 to 0.55 mole fraction KCl or KBr—NaCl at 0.45 to 0.55 mole fraction KBr.

9. The salt core of claim 8, wherein the salt core is a fused salt core and forms internal passages in a cast part.

10. The salt core of claim 9, wherein the internal passages are in a closed deck engine block.

11. The salt core of claim 8, wherein parts cast from the salt core exhibit less cracking than parts cast from traditional salt cores.

12. The salt core of claim 8, wherein the salt core alloy has a shrinkage value less than a shrinkage value for a eutectic salt mixture.

13. The salt core of claim 8, wherein the salt core alloy has a shrinkage value less than either of the two pure salts that comprise the alloy.

14. The salt core of claim 1, wherein the salt core alloy has a shrinkage value less than a shrinkage value for a eutectic salt mixture.

15. The salt core of claim 1, wherein the salt core alloy has a shrinkage value less than either of the two pure salts that comprise the alloy.

* * * * *